US008376538B2

(12) United States Patent
Takata

(10) Patent No.: US 8,376,538 B2
(45) Date of Patent: Feb. 19, 2013

(54) LIQUID JETTING APPARATUS AND LIQUID SUPPLY UNIT OF LIQUID JETTING APPARATUS

(75) Inventor: Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 474 days.

(21) Appl. No.: 12/621,751

(22) Filed: Nov. 19, 2009

(65) Prior Publication Data

US 2010/0123765 A1 May 20, 2010

(30) Foreign Application Priority Data

Nov. 19, 2008 (JP) ..... 2008-296008

(51) Int. Cl.
*B41J 2/19* (2006.01)
*B41J 2/175* (2006.01)

(52) U.S. Cl. ..... 347/92; 347/85

(58) Field of Classification Search ..... 347/84, 347/85, 86, 92
See application file for complete search history.

(56) References Cited

U.S. PATENT DOCUMENTS 7,025,445 B2 * 4/2006 Thielman et al. ..... 347/85
7,287,842 B2 * 10/2007 Aruga ..... 347/84
7,467,858 B2 * 12/2008 Lebron et al. ..... 347/85
2007/0229629 A1 * 10/2007 Miyazawa et al. ..... 347/86
2008/0204506 A1 8/2008 Nakamura et al.

FOREIGN PATENT DOCUMENTS

JP 2007-175996 A 7/2007
JP 2008-238815 A 10/2008
JP 2008-240799 A 10/2008

OTHER PUBLICATIONS

Japan Patent Office, Notice of Reasons for Rejection for Patent Application No. 2008-296008, mailed Sep. 14, 2010. (counterpart to above-captioned U.S. patent application).

* cited by examiner

*Primary Examiner* — Jannelle M Lebron
(74) *Attorney, Agent, or Firm* — Baker Botts L.L.P.

(57) ABSTRACT

A liquid jetting apparatus includes a liquid jetting head; a liquid supply channel which supplies the liquid to the liquid jetting head; an air discharge mechanism which discharges air existing in the liquid, the air discharge mechanism including an air storage portion, an air discharge passage, a valve, and a flexible member. When a negative pressure is generated in the air discharge passage, the flexible member is deformed to open the valve, and to discharge the air inside the air storage portion via the air discharge passage. Accordingly, the size of the apparatus can be made small while making it possible to discharge the air accumulated in the head unit.

17 Claims, 16 Drawing Sheets

FOURTH STEP

FIFTH STEP

SIXTH STEP

LIQUID JETTING APPARATUS AND LIQUID SUPPLY UNIT OF LIQUID JETTING APPARATUS

CROSS REFERENCE TO RELATED APPLICATION

The present application claims priority from Japanese Patent Application No. 2008-296008, filed on Nov. 19, 2008, the disclosure of which is incorporated herein by reference in its entirety.

BACKGROUND OF THE INVENTION

1. Field of the Invention

The present invention relates to a liquid jetting apparatus such as an ink jet printing apparatus having an air discharge mechanism which discharges air existing in a liquid to be supplied to the jetting head, and to a liquid supply unit of the liquid jetting apparatus.

2. Description of the Related Art

As an ink-jet printing apparatus which is an example of a liquid jetting apparatus, a printing apparatus in which a so-called tube-supply method is adopted has hitherto been known. In this case, an ink is supplied to a jetting head, which reciprocates while facing or be opposite to a recording paper, from an ink cartridge provided in the body of the ink-jet printing apparatus (apparatus body), via a flexible ink supply tube. In such a printing apparatus, it is required to make the capacity or volume of the ink cartridge be large or increased, and to make the size of the apparatus be compact. The means for achieving the large capacity and compactness can be exemplified by making the size of a liquid supply unit be small, the liquid supply unit including a jetting head, reciprocating integrally with the jetting head and also guiding the ink to the jetting head from or via the ink supply tube.

Note that when, in particular, the frequency of use of the printing apparatus is low, it has been known that air (an air bubble) is developed or grown in a channel (flow passage) which guides the ink from the ink cartridge to the jetting head. When this air enters into the jetting head, there is a possibility that desired jetting characteristics might not be achieved. To address such a situation, when an air storage portion which traps air is provided on the channel of the liquid supply unit at an intermediate portion of the channel, it is possible to prevent the air from entering into the jetting head. However, when the capacity of the air storage portion is made great or substantial in order to trap more air, it is difficult to make the size of the liquid supply unit be small. Therefore, a mechanism has been proposed in which an air storage portion having a small capacity is provided on the liquid supply unit, and the air is discharged forcibly from the air storage portion at a predetermined timing (see Japanese Patent Application Laid-open No. 2007-175996).

Japanese Patent Application Laid-open No. 2007-175996 discloses a structure including a liquid supply unit having an air storage portion which is closed normally by biasing a valve element (valve member) toward a direction of closing by a coil spring; and a valve rod which is provided at a predetermined standby position on a side of the body of the printing apparatus. Further, in a case that the air inside the air storage portion is to be discharged, a carriage which integrally accommodates the jetting head and the liquid supply unit is arranged (made to be located) at the standby position, and the valve element of the liquid supply unit is pressed by the valve rod, thereby opening the valve element resisting against the biasing force of the coil spring. Furthermore, a negative pressure is generated by a pump provided on the side of the apparatus body, and the air inside the air storage portion is discharged.

However, in the structure described in Japanese Patent Application Laid-open No. 2007-175996, the size of the valve element and the size of the valve rod are comparatively small. Accordingly, for pressing or pushing the valve element with the valve rod, it is necessary to position the liquid supply unit to the standby position highly accurately. Further, at the time of discharging air, the pump on the side of the apparatus body is connected to the air storage portion on a side of the liquid supply unit. On the other hand, at the time of printing, the pump on the side of the apparatus body is separated (is disconnected) from the air storage portion on the side of the liquid supply unit. Therefore, upon discharging the air, it is necessary to secure the air-tightness of the air discharge channel at a location at which apparatus body and the liquid supply unit are connected. Furthermore, in addition to the pump, it is necessary to separately provide, on the apparatus body, a valve-element opening mechanism which includes the valve rod, corresponding to a standby position of the liquid supply unit. Therefore, it is difficult to realize the small size of the printing apparatus.

SUMMARY OF THE INVENTION

In view of the above-described circumstances, an object of the present invention is to provide a liquid jetting apparatus which is provided with an air discharge mechanism, which is capable of discharging air accumulated or stored at an intermediate portion of the liquid supply channel of the liquid supply unit, and in which the size of the apparatus can be made small. Further, another object of the present invention is to provide a liquid jetting apparatus in which there is no need to arrange the liquid supply at a predetermined position at the time of discharging air, and which is capable of easily secure the air-tightness of the air discharge channel. Furthermore, still another object of the present invention is to provide a liquid supply unit which can be used in such liquid jetting apparatus.

According to a first aspect of the present invention, there is provided a liquid jetting apparatus which jets a liquid, the apparatus including: a liquid jetting head; a liquid supply channel which supplies the liquid to the liquid jetting head; and an air discharge mechanism which discharges air existing in the liquid which is to be supplied to the liquid jetting head, the air discharge mechanism including an air storage portion which is provided at an intermediate portion of the liquid channel, and which temporarily stores air in the liquid, an air discharge passage which extends from the air storage portion up to an outside of the air discharge mechanism, a valve which opens and closes the air discharge passage, and a flexible member which is deformed in accordance with a pressure inside the air discharge passage;

wherein when a negative pressure is generated in the air discharge passage, the flexible member is deformed to open the valve, and to discharge the air inside the air storage portion to the outside via the air discharge passage.

By providing such a structure, it is possible to discharge the air inside the air storage portion by generating the negative pressure, for example with a pump, in the air discharge passage. In other words, it is not necessary to separately provide any valve-element opening mechanism in addition to the pump, and it is also possible to open and close the air discharge passage through (communicating with) the air storage portion by the negative pressure, generated with the pump for discharging the air. Consequently, it is possible to reduce the volume or capacity of the air discharge portion and to make the size of the liquid jetting apparatus such as a printer be small, since the valve-element opening mechanism is unnecessary. Further, when the pump and the air discharge passage of the air discharge mechanism are kept connected all the time by a flexible tube, it is possible to carry out the air discharge operation (air discharge process) without stopping the liquid supply unit at a predetermined position, and it is possible to secure the air-tightness of the air discharge passage comparatively easily.

Further, according to a second aspect of the present invention, there is provided a liquid supply unit which is provided on a liquid jetting apparatus including a liquid jetting head and jetting a liquid, the liquid supply unit including: a liquid supply channel which supplies the liquid to the liquid jetting head; and an air discharge mechanism which discharges air inside the liquid supply channel, the air discharge mechanism including an air storage portion which is provided at an intermediate portion of the liquid supply channel and which temporarily stores air in the liquid, a valve which opens and closes an air discharge passage extending from the air storage portion up to an outside of the air discharge passage, and a flexible member which is deformed in accordance with a pressure inside the air discharge passage;

wherein when a negative pressure is generated in the air discharge passage, the flexible member is deformed to open the valve and to discharge the air inside the air storage portion to the outside via the air discharge passage.

By providing such a structure, it is possible to discharge the air inside the air storage portion by generating the negative pressure in the air discharge passage with, for example, a pump provided outside the liquid supply unit, and thus it is not necessary to separately provide any valve-element opening mechanism in addition to the pump. Consequently, it is possible to reduce the volume or capacity of the air storage portion and to make the size of the air supply unit to be small, thereby realizing the small-sized the liquid jetting apparatus such as a printing apparatus, since the valve-element opening mechanism is unnecessary. Further, when the pump and the air discharge passage of the air discharge mechanism are kept connected all the time by a flexible tube, it is possible to carry out the air discharge operation without making the liquid supply unit be stopped at a predetermined position, and it is possible to secure the air-tightness of the air discharge passage comparatively easily.

According to the present invention, it is possible to provide a liquid jetting apparatus which is capable of discharging air stored in a head unit, and which can be made small or compact. Moreover, it is possible to provide a liquid jetting apparatus in which it is not necessary to arrange the head unit at a predetermined position for discharging air, and it is possible to easily secure the air-tightness of the air discharge passage. Furthermore, it is possible to provide a liquid supply unit which can be used in such a liquid jetting apparatus.

BRIEF DESCRIPTION OF THE DRAWINGS

FIGS. 10A and 10B are diagrams for explaining an operation of the air discharge mechanism, wherein FIG. 10A shows a state in which a valve chamber has an atmospheric pressure, and FIG. 10B shows a state in which the valve chamber has a negative pressure;

FIGS. 16A and 16B are diagrams showing another structure of the damper unit, wherein FIG. 16A shows an overall perspective view, and FIG. 16B shows a perspective view as taken along a line XVIB-XVIB shown in FIG. 16A.

DETAILED DESCRIPTION OF THE PREFERRED EMBODIMENTS

In the following, a liquid jetting apparatus and a liquid supply unit according to an embodiment of the present invention will be described exemplified by a structure when an ink jet printing apparatus (hereinafter, called as a "printing apparatus") having a jetting head is used, with reference to the accompanying drawings. In the following description, a direction in which the ink is jetted from the jetting head is a downward direction (down direction, down), and a direction opposite to the direction of jetting is an upward direction (up direction, up). A scanning direction of the jetting head is used synonymously as a left-right direction, and a direction orthogonal to both the up and down direction (vertical direction) and the left-right direction is a frontward direction (front direction, front) and a rearward direction (rear direction, rear). In this patent application, the directions of "left", "right", "front", and a "rear" are defined based on those shown in FIG. 1 as the reference.

<Outline of the Structure of Printing Apparatus>

Figure 1:
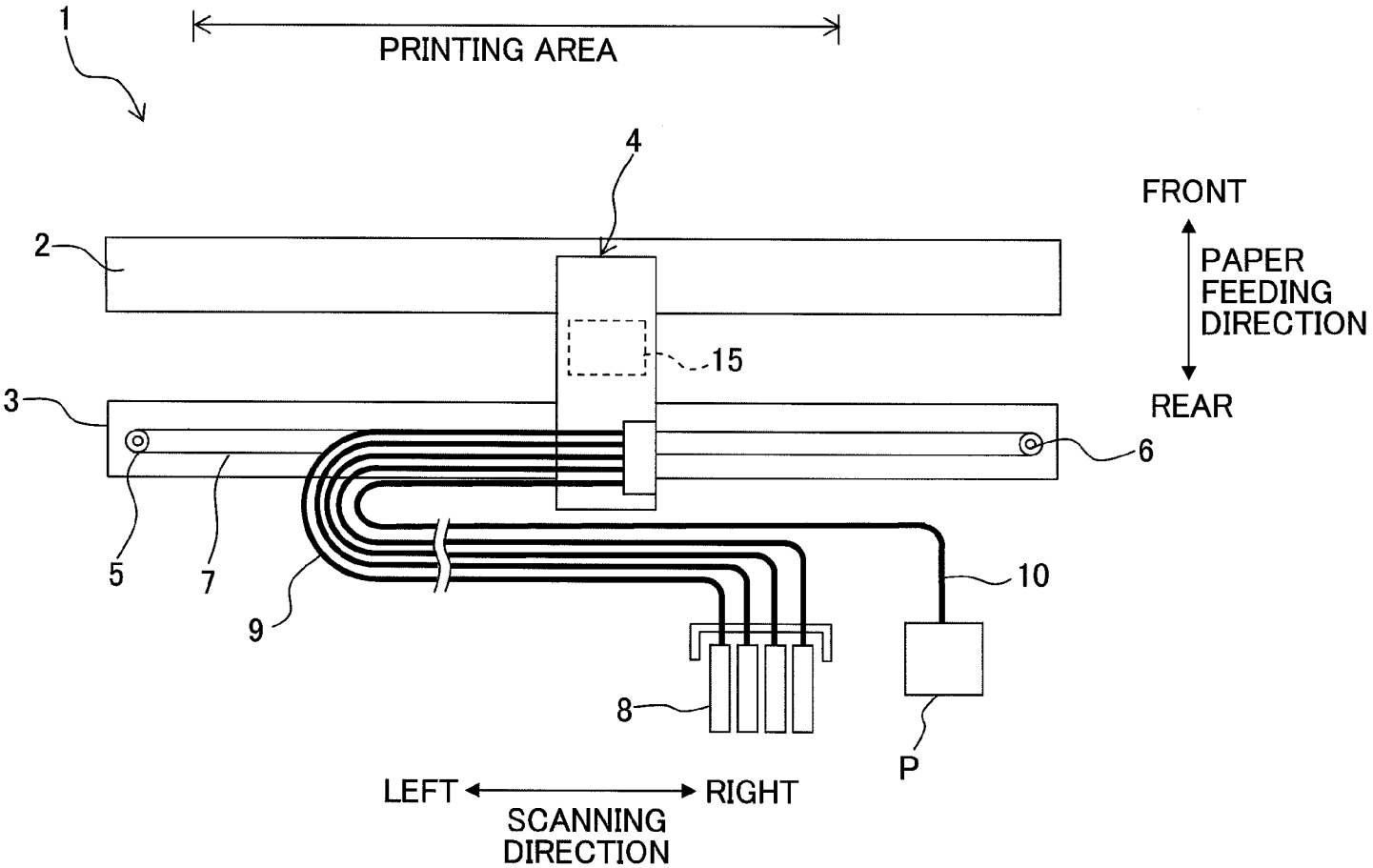
FIG. 1 is a schematic plan view showing main components of a printing apparatus as a liquid jetting apparatus which includes a liquid supply unit, according to an embodiment of the present invention.

As shown in FIG. 1, in a printing apparatus 1, a pair of guide rails 2 and 3 which are extended in the left-right direction is provided to be substantially parallel with each other; and a liquid supply unit 4 is supported, by the guide rails 2 and 3, to be slidable in the scanning direction. A pair of pulleys 5 and 6 is provided in the vicinity of left-right end portions of the guide rail 3 respectively, and the liquid supply unit 4 is joined to (linked to) a timing belt 7 which is wound around the pulleys 5 and 6. A motor (not shown in the drawings) which drives and rotates the pulley 6 in a normal direction and a reverse direction is provided on the pulley 6. When the pulley 6 is driven and rotated in the normal direction and the reverse direction, the timing belt 7 reciprocates in the left direction and the right direction. With the reciprocating of the timing belt 7 in the left and right direction, the liquid supply unit 4 is subjected to reciprocal scanning in the left-right direction along the guide rails 2 and 3.

In the printing apparatus 1, four ink cartridges 8 are detachably attached to be exchangeable. Further, four ink supply tubes 9 which are flexible are connected to the liquid supply unit 4, and inks of four colors (black, cyan, magenta, and yellow) are supplied to the liquid supply unit from the four ink cartridges 8 respectively. A jetting head 15 (see also FIG. 2) is provided on the liquid supply unit 4 at a lower portion of the liquid supply unit 4. At a position below or under the jetting head 15, the inks (liquids) are jetted from the jetting head 15 toward a recording body (recording medium) (such as a recording paper) which is transported in a direction orthogonal to the scanning direction (paper feeding direction). In this manner, it is possible to form an image on the recording body.

Figure 2:
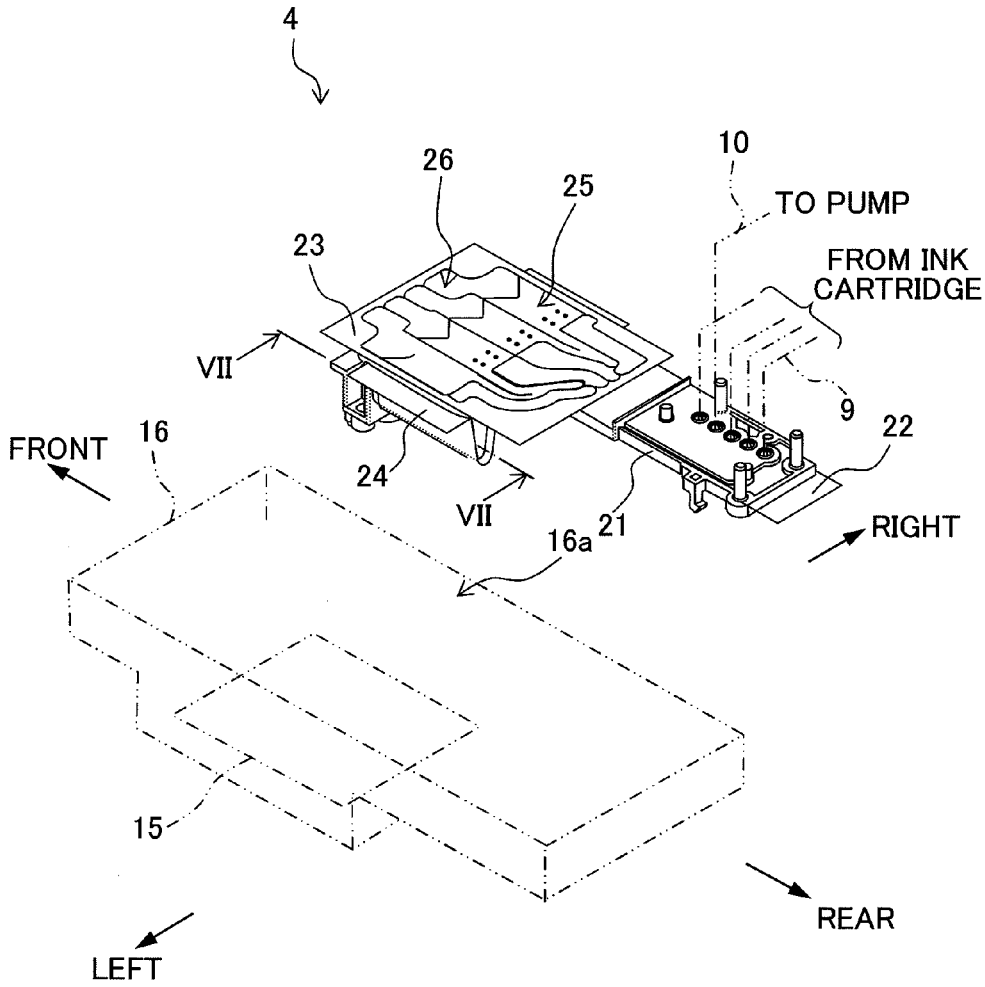
FIG. 2 is an exploded perspective view showing the structure of a carriage unit included in the printing apparatus shown in FIG. 1.

As shown in FIG. 2, the liquid supply unit 4 includes a carriage case 16 which supports the jetting head 15, and a damper unit 20 which is provided (attached, mounted) on the carriage case 16 at a position above the jetting head 15. The carriage case 16 is substantially rectangular shaped which is long in the front and rear direction in a plan view. The carriage case 16 is box-shaped in which an opening 16*a* is formed at an upper portion thereof. The damper unit 20 is attached via the opening 16*a*.

The damper unit 20 has a substrate (channel forming substrate) 21 which is a molding of resin, and is long in the front and rear direction; and a plurality of films 22, 23, and 24 (hereinafter referred to as "films 22 to 24") each of which is in the form of a rectangular sheet and which are thermally welded or adhered to the substrate 21. The above-described ink supply tubes 9 and an air discharge tube 10 (see also FIG. 1) are connected to a rear portion of the substrate 21. Further, a damper device (damper apparatus) 25 which reduces pressure fluctuation in the ink is provided at a front portion of the damper unit 20. Furthermore, a sub tank 26 which temporarily stores the ink is provided at a front side of the damper unit 20. The inks which are supplied to the damper unit 20 through the ink supply tubes 9, upon passing through the damper device 25 and the sub tank 26, are supplied to the jetting head 15. The structure of the damper unit 20 will be described below in further detail.

<Structure of Damper Unit (Channel)>

Figure 4A:
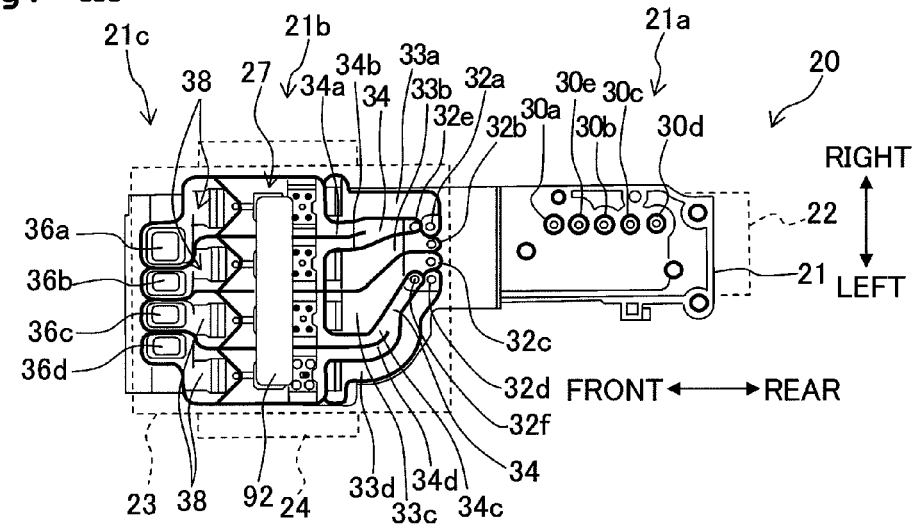
FIGS. 4A to 4C are a plan view, a side view, and a bottom view of the damper unit, respectively.
Figure 4B:
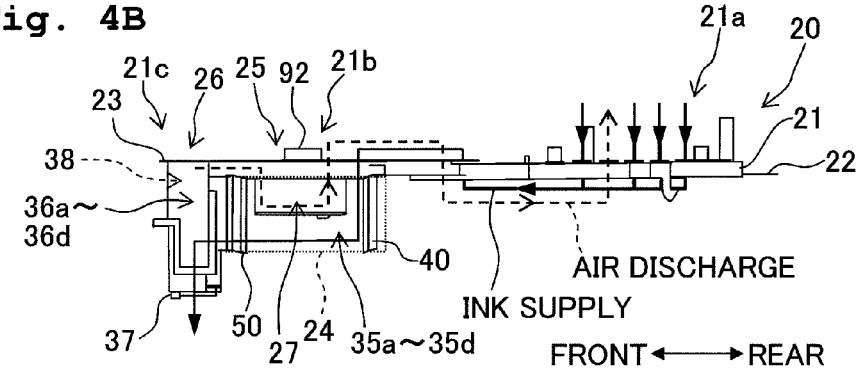
Figure 4C:
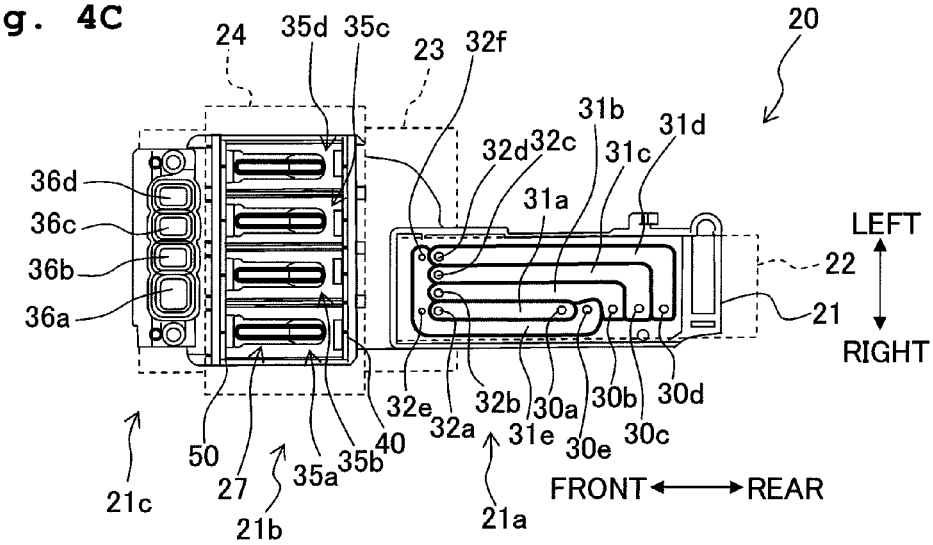

As shown in FIGS. 4A, 4B and 4C, the substrate 21 of the damper unit 20 includes a channel forming portion 21*a* which is positioned at a rear portion, a damper forming portion 21*b* which is positioned at a front side of the channel forming portion 21*a*, and a tank forming portion 21*c* which is positioned at further front side of the damper forming portion 21*b*. The width (length in the left-right direction) of the channel forming portion 21*a* is smaller than the widths of the damper forming portion 21*b* and the tank forming portion 21*c*.

As shown in FIGS. 4A, 4B and 4C, one discharge-air tube connecting hole 30*e* and four supply tube connecting holes 30*a*, 30*b*, 30*c*, and 30*d* (hereinafter referred to as "supply tube connecting holes 30*a* to 30*d*") which are formed penetrating through the channel forming portion 21*a* in the up and down direction at a right-side portion which is located at the rear side of the channel forming portion 21*a* such that the supply tube connecting holes 30*a* to 30*d* are arranged closely and adjacently and aligned in a row in the front and rear direction. The supply tube connecting holes 30*a* to 30*d* are arranged in this order from the front to rear side, and the discharge-air tube connecting hole 30*e* is provided between the supply tube connecting hole 30*a* and the supply tube connecting hole 30*b* which are located as first and second holes respectively from the front side. Moreover, four supply bypass holes 32*a*, 32*b*, 32*c*, and 32*d* (hereinafter referred to as "supply bypass holes 32*a* to 32*d*") and two discharge-air bypass holes 32*e* and 32*f* are formed penetrating through the channel forming portion 21*a* in the up and down direction, at a front end portion of the channel forming portion 21*a*. The supply bypass holes 32*a* to 32*d* are arranged in a row in the left-right direction, and the discharge-air bypass holes 32*e* and 32*f* are arranged at a front side of the supply bypass holes 32*a* and 32*d*, the discharge-air bypass holes 32*e* and 32*f* being positioned at the both ends of the supply bypass holes 32*a* to 32*d*. The ink supply tubes 9 extended from the ink cartridges 8 are connected to the supply tube connecting holes 30*a* to 30*d*, and the air discharge tube 10 extended from a pump P, which is provided inside the printing apparatus 1, is connected to the discharge-air tube connecting hole 30*e* (see FIGS. 1 and 2). Since the supply tube connecting holes 30*a* to 30*d* and the discharge-air tube connecting hole 30*e* are closely arranged in such manner, it is possible to make the substrate 21 be compact. Further, it is possible to bundle the ink supply tubes 9 and the air discharge tube 10 connected to these holes, and to suppress a variation in negative pressure which acts on the liquid supply unit 4 at the time of scanning.

As shown in FIG. 4C, five grooves in the form of a recess dented upward (dented in the up direction) are formed on a side of the bottom surface of the channel forming portion 21*a*, and the bottom surface of the channel forming portion 21*a* is covered by a film 22. Accordingly, four ink introducing channels 31*a*, 31*b*, 31*c*, and 31*d* (hereinafter referred to as "ink introducing channels 31*a* to 31*d*") extending from the supply tube connecting holes 30*a* to 30*d* up to the supply bypass holes 32*a* to 32*d*, and one discharge-air introducing channel 31*e* extending from the discharge-air tube connecting hole 30*e* up to the discharge-air bypass holes 32*e* and 32*f* are formed. The ink introducing channel 31*a* is extended to be straight in the front direction from the supply tube connecting hole 30*a* positioned at the frontmost position, and communicates with the supply bypass hole 32*a* positioned at the right-side end. The ink introducing channel 31*b* is extended from the supply tube connecting hole 30*b* positioned at the rear side of the supply tube connecting hole 30*a*. The ink introducing channel 31*b* is extended toward the left side in order to bypass the supply tube connecting hole 30*a*, and then is bent at an intermediate portion of the ink introducing channel 31*b* to be directed in the front direction, and communicates with the supply bypass hole 32*b* which is adjacent to the supply bypass hole 32*a*. The ink introducing channels 31*c* and 31*d* are extended from the supply tube connecting holes 30*c* and 30*d* positioned at a further rear side of the supply tube connecting hole 30*b*. Similarly as the above-described ink introducing channel 31*b*, the ink introducing channels 31*c* and 31*d* are extended toward the left side and then is bent to be directed in the front direction, and communicate with the supply bypass holes 32*c* and 32*d*, respectively.

On the other hand, the discharge-air introducing channel 31*e* is extended from the discharge-air tube connecting hole 30*e*. The discharge-air introducing channel 31*e* is extended toward the right side in order to bypass the supply tube connecting hole 30*a* and the ink introducing channel 31*a*, and then is bent at an intermediate portion of the discharge-air introducing channel 31*e* to be directed in the front direction, and is further bent at a position in front of the supply bypass hole 32*a*; the discharge-air introducing channel 31*e* communicates with the discharge-air bypass hole 32*e* which is the first hole among the holes 32*e* and 32*f* while extending toward the left side, and communicates with the discharge-air bypass hole 32*f* which is the second hole at the end portion of the discharge-air introducing channel 31*e*. In this manner, the ink introducing channels 31*a* to 31*d* and the discharge-air introducing channel 31*e*, extending from the tube connecting holes 30*a* to 30*e* up to the supply bypass holes 32*a* to 32*d* and the discharge-air bypass holes 32*e* and 32*f*, respectively, are laid out such that the paths (channels) do not intersect with one another.

As shown in FIG. 4A, grooves in the form of recesses communicating individually with the four supply bypass holes 32*a* to 32*d* respectively are formed in the upper surface of the damper forming portion 21*b* of the substrate 21. The upper surfaces of the damper forming portion 21*b* and the tank forming portion 21*c* are covered by the film 23 (see FIG. 3) which is a flexible member. With this, ink connecting channels 33*a*, 33*b*, 33*c* and 33*d* (hereinafter referred to as "ink connecting channels 33*a* to 33*d*") which are extended in the frontward are formed. Further, these ink connecting channels 33*a* to 33*d* communicate with upper portions of four ink storage chambers 35*a*, 35*b*, 35*c* and 35*d* (hereinafter referred to as "ink storage chambers 35*a* to 35*d*") respectively, which are formed at a front portion of the damper forming portion 21*b*, and are arranged to be aligned in the left-right direction.

Furthermore, a groove which communicates with the discharge-air bypass hole 32*f* is formed between the ink connecting channels 33*a* and 33*b* which are adjacent to each other, and a groove which communicates with the discharge-air bypass hole 32*e* is formed between the ink connecting channels 33*c* and 33*d*; these grooves are also covered by the film 23. With this, discharge air connecting channels 34 extended in the front direction are formed. Among these discharge-air connecting channels 34, the discharge-air connecting channel 34 which is extended from the discharge-air bypass hole 32*f* is branched into two at an intermediate portion of the discharge-air connecting channel 34, becoming discharge-air connecting channels 34*a* and 34*b*, and communicates with an air discharge mechanism 27 which will be described later. Similarly, the discharge-air connecting channel 34 which is extended from the discharge-air bypass hole 32*e* is branched into two at an intermediate portion of the discharge-air connecting channel 34, becoming discharge-air connecting channels 34*c* and 34*d*, and communicates with the air discharge mechanism 27.

Figure 3:
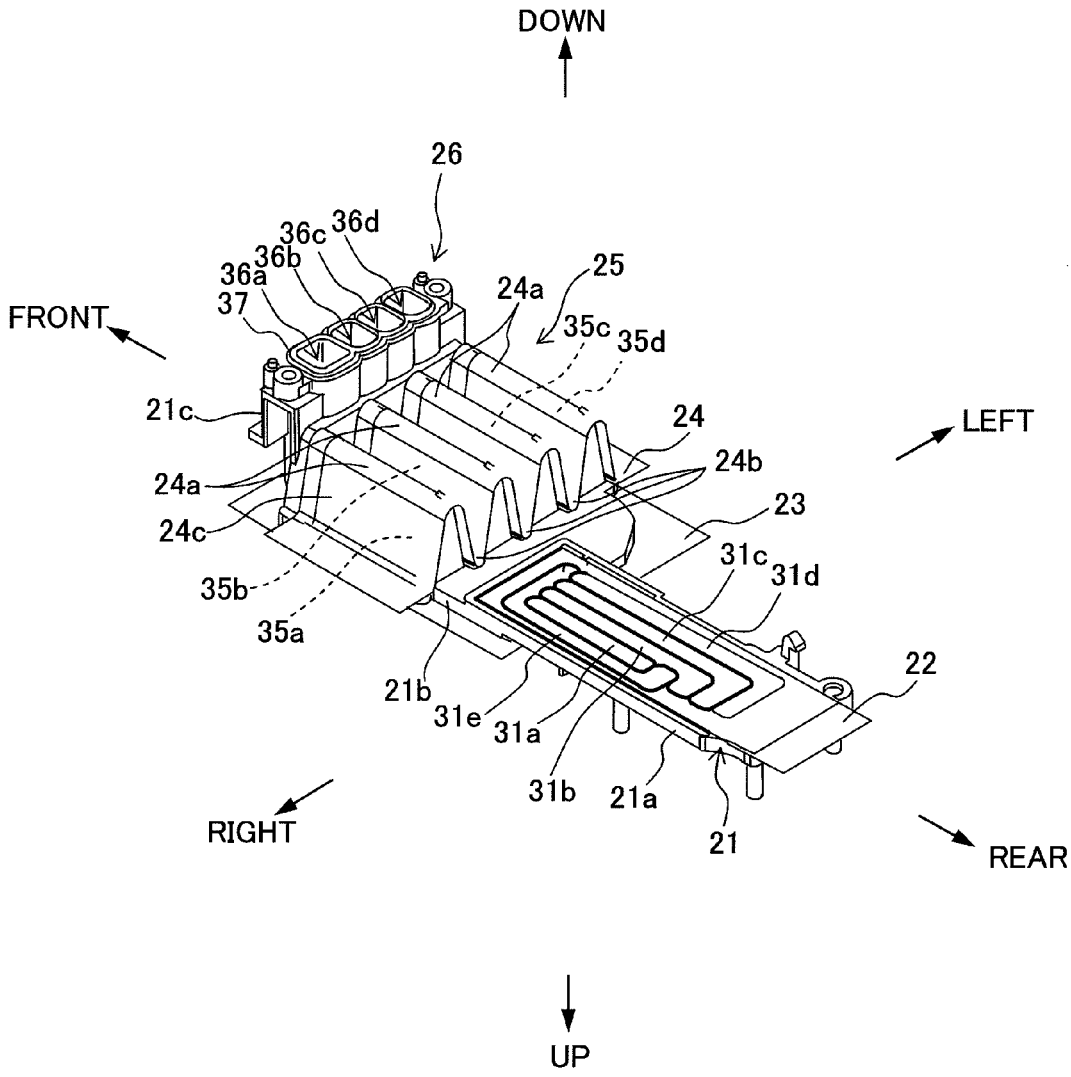
FIG. 3 is a perspective view of a damper unit which is provided on the liquid supply unit, shown in FIG. 2, as seen from a side therebelow.

As shown in FIG. 3, the ink storage chambers 35*a* to 35*d* are covered by the films 23 and 24 from the up and down direction, and form the damper device 25. Further, a cross-section of the ink storage chambers 35*a* to 35*d*, which is orthogonal to the front and rear direction, is substantially inverted-triangular shaped, and the overall shape or contour thereof is in the form of a substantial triangular pole (triangular prism) extended in the front and rear direction. The ink storage chambers 35*a* to 35*d* are arranged to be aligned in this order from the right side to the left side of the damper forming portion 21*b*. The materials and thickness of the films 23 and 24 can be arbitrary as long as the films 23 and 24 have enough flexibility to function as a dumper as described below. Preferably, a flexible film for the films 23 and 24 can be formed as stacked thin films which are made of thin films of, for example, polypropylene, polyethylene, nylon and polyethylene terephthalate. Preferably, a total thickness of the flexible film can range from about 10 μm to about 100 μm, more preferably the total thickness can be about 50 μm. The flexible film can be formed as multi-layers or a single-layer.

The sub tank 26 which includes four tank chambers 36*a*, 36*b*, 36*c*, and 36*d* (hereinafter referred to as "tank chambers 36*a* to 36*d*") formed in the tank forming portion 21*c* is provided at a front side of the ink storage chambers 35*a* to 35*d*. The tank chambers 36*a* to 36*d* are arranged in a row in this order from the right side to the left side of the tank forming portion 21*c*, and upper portions of the tank chambers 36*a* to 36*d* are covered by the film 23, together with the ink storage chambers 35*a* to 35*d*. Further, upper-portion spaces of the ink storage chambers 35*a* to 35*d* and upper-portion spaces of the tank chambers 36*a* to 36*d*, which corresponding to the ink storage chambers 35*a* to 35*d*, mutually communicate respectively, thereby making the ink entry and exit to be possible. Furthermore, these upper-portion spaces form an air storage portion (air accumulating portion) 38 (see FIGS. 4A, 4B and 4C) which stores or accumulates air temporarily. Moreover, as shown in FIG. 3, a seal member 37 in which four holes communicating with the tank chambers 36*a* to 36*d* are formed is attached to a lower portion of the sub tank 26. When the damper unit 20 is attached to the carriage case 16 (see FIG. 2), a lower end of the seal member 37 is connected to the jetting head 15.

As shown by solid-line arrows in FIG. 4B, liquid supply channels from the supply tube connecting holes 30*a* to 30*d* up to the seal member 37 are formed in the above-described damper unit 20. The inks from the ink supply tubes 9 are supplied to the liquid supply channels from a side of the upper surface of the substrate 21. The supplied inks are guided from the supply tube connecting holes 30*a* to 30*d* to the supply bypass holes 32*a* to 32*d* via the ink introducing channels 31*a* to 31*d* on the side of the lower surface of the substrate 21, and are further made to pass through the ink connecting channels 33*a* to 33*d* on the side of the upper surface of the substrate 21 via the supply bypass holes 32*a* to 32*d*, and are introduced or poured into the ink storage chambers 35*a* to 35*d* respectively of the damper device 25. Furthermore, the ink inside each of the ink storage chambers 35*a* to 35*d* is guided to one of the tank chambers 36*a* to 36*d*, which are communicating with the ink storage chambers 35*a* to 35*d* at the upper portions thereof, is directed to a lower portion of one of the tank chambers 36*a* to 36*d*, and then is supplied to the jetting head 15 (see FIG. 2) connected to one of the tank chambers 36*a* to 36*d* via the seal member 37.

While the ink flows through the liquid supply channel, when a pressure of the ink is varied or fluctuated due to the liquid supply unit 4 being subjected to the scanning, etc., the pressure fluctuation is alleviated or suppressed by the damper device 25. Moreover, the air grown in the ink is stored or accumulated in the air storage portion 38 provided at the intermediated portion of the above-described liquid supply channel, and is discharged to an outside via the air discharge mechanism 27 at a predetermined timing (see broken-line arrows shown in FIG. 4B). Therefore, in the following, the structure of damper device 25 is first described, and then the structure of the air discharge mechanism 27 is described in detail.

<Structure of Damper Unit>

Figure 5:
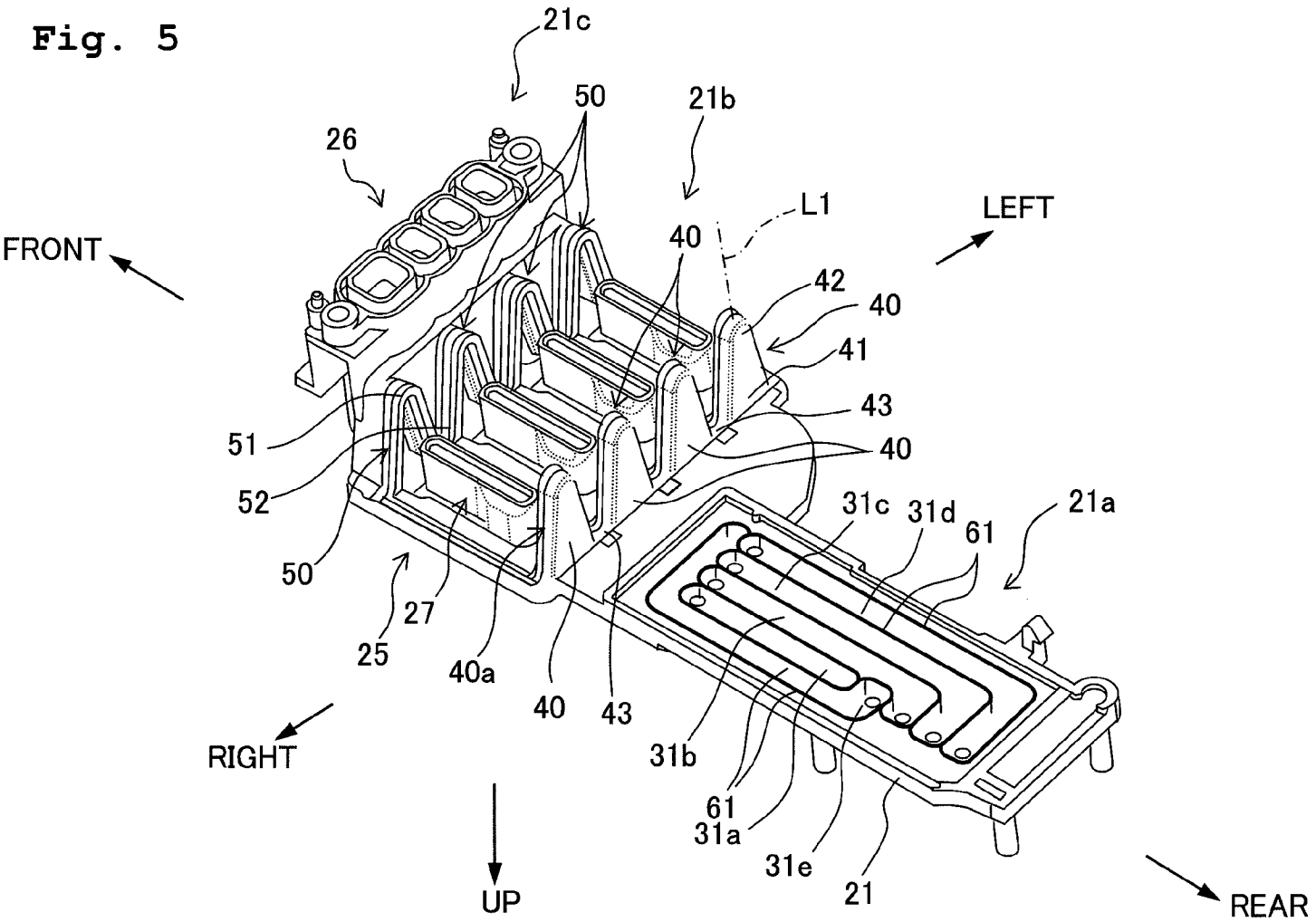
FIG. 5 is a diagram for explaining the structure of the damper device, and is an exploded perspective view of a substrate as seen from a side therebelow.
Figure 6:
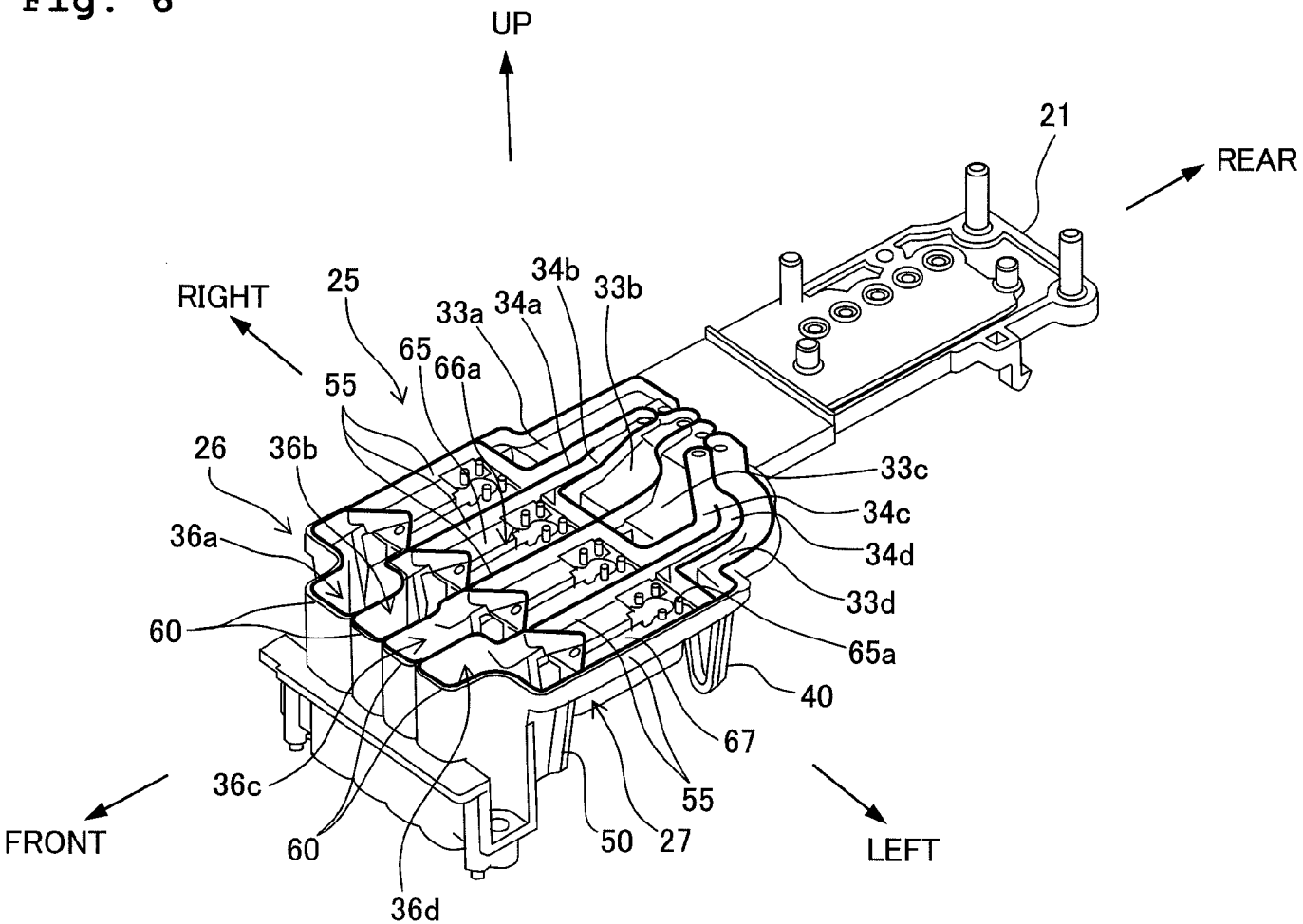
FIG. 6 is a perspective view of the substrate, shown in FIG. 5, as seen from a side thereabove.

As shown in FIGS. 5 and 6, four elastic walls 40 having a substantially triangular shape are provided to protrude on the lower surface of the damper forming surface 21*b* of the substrate 21, the lower surface forming the damper unit 20. The elastic walls 40 are arranged in a row in the left-right direction such that the normal direction thereof coincides with the front and rear direction. Four supporting edge portions 50 are provided at a position in front of the elastic walls 40 such that the supporting edge portions 50 face the elastic walls 40 and that the supporting edge portions 50 are separated by a same distance from the elastic walls 40. In other words, the elastic walls 40 and the supporting edge portions 50 are arranged on the lower surface of the damper forming portion 21*b* to form pairs of the elastic wall and supporting edge portion so as to face each other in the front and rear direction. Four such pairs each including one of the elastic walls 40 and one of the supporting edge portions 50 are arranged to be aligned in the left-right direction.

As shown in FIG. 5, the elastic walls 40 have a same shape, and the shape of each of the elastic walls 40 is a substantially triangular shape in which a base portion 41 connected to the substrate 21 is let the base, and an end portion farthest from the substrate 21 is an apex portion 42 having a substantially triangular shape; and each of the elastic walls 40 is bilaterally symmetrical with respect to a virtual line L1 in the up and down direction connecting the base portion 41 and the apex portion 42. Further, the apex portion 42, as seen in a rear view, is rounded to be circular arc shaped and protruding upward, and a recess-shaped connecting portion 43 having a circular arc shape dented upward (dented in the up direction) is formed between the base portions 41 of the adjacent elastic walls 40. On the other hand, the supporting edge portion 50 has a shape having a contour or outline substantially same as a peripheral portion 40*a* of the above-described elastic wall 40, and has an apex portion 51 and a recess-shaped connecting portion 52 similar to the apex portion 42 and the recess-shaped connecting portion 43 respectively.

Cross-linking ribs (cross-bridge ribs) 55 (see FIG. 6) extended in the front and rear direction are provided each between the recess-shaped connecting portion 43 between the adjacent elastic walls 40 and the recess-shaped connecting portion 52 between the supporting edge portions 50 corresponding to the recess-shaped connecting portion 43. Further, similar cross-linking ribs 55 (see FIG. 6) are also provided each between an outer-side end portion in the left-right direction of the base portion 41 of one of the elastic walls 40 positioned at the left and right ends and an end portion of one of the supporting edge portions 50 which corresponding to the outer-side end portion in the left-right direction of one of the elastic walls 40 positioned at the left and right ends. Accordingly, in this embodiment, the four elastic walls 40 and the four supporting edge portions 50 are connected or linked by the five cross-linking ribs 55 in total.

As shown in FIG. 6, on the upper surface of the substrate 21, a connecting edge portion 60 with the film 23 is formed along the upper surfaces of peripheral portions of the ink connecting channels 33*a* to 33*d* and the discharge-air connecting channels 34*a* to 34*d*, the upper surfaces of the cross-linking ribs 55, and the upper surface of a wall portion which partitions the tank chambers 36*a* to 36*d*. The connecting edge portion 60 is formed to be positioned in substantially a same plane throughout the entire length thereof. Moreover, as shown in FIG. 5, also on the lower surface of the substrate 21, a connecting edge portion 61 with the film 22 is formed along the upper surfaces of peripheral edge portions of the ink introducing channels 31*a* to 31*d* and the discharge-air introducing channel 31*e*; and the connecting edge portion 61 also is formed to be positioned in substantially a same plane throughout the entire length thereof.

In this embodiment, the film 24 which is a flexible member in the form of a rectangular sheet is thermally welded or adhered to the above-described elastic walls 40, supporting edge portions 50, and cross-linking ribs 55 by a predetermined procedure, and the film 23 is thermally welded or adhered to the connecting edge portion 60 on the upper surface of the substrate 21. Accordingly, the damper device 25 (see FIG. 3) having the ink storage chambers 35*a* to 35*d* surrounded by the films 23, 24, the elastic walls 40, and the supporting edge portion 50*s* is formed; and at the same time, the sub tank 26 having the tank chambers 36*a* to 36*d* is also formed. Moreover, the film 22 is thermally welded also to the connecting edge portion 61 of the lower surface of the substrate 21 to thereby form the ink introducing channels 31*a* to 31*d* and the discharge-air introducing channel 31*e*.

In the damper device 25 formed in this manner, the shape of each of the ink storage chambers 35*a* to 35*d* is a substantially triangular-pillar shape extended in the front and rear direction that is an alignment direction in which the elastic walls 40 and the supporting edge portions 50 forming the pairs respectively are aligned. Further, a cross section of each of the ink storage chambers 35*a* to 35*d* orthogonal to the axial direction thereof (in other words, the alignment direction in which the elastic walls 40 and the supporting edge portions 50 forming the pairs respectively are arranged, the front and rear direction) is a triangular shape (inverted-triangular shape in a posture when being used, as shown in FIG. 2) which is similar to that of the elastic wall 40, with respect to the cross section at any location in the axial direction. Moreover, a peripheral surface, of each of the ink storage chambers 35*a* to 35*d*, which is defined by the film 24 is formed to have a shape of a curved surface. Specifically, as shown in FIG. 3, a ridge portion 24*a* having a circular-arc shaped cross section, of which peripheral surface is defined to be a curved surface by the film 24, is formed at a portion connecting the apex portions 42 and 51 of each of the elastic walls 40 and each of the supporting edge portions 50; and a trough portion 24*b* having a circular-arc shaped cross-section, of which peripheral surface is defined to have a shape of the curved surface by the film 24, is formed at a portion connecting each of the recess-shaped connecting portions 43 and each of the recess-shaped connecting portions 52. Since the trough portion 24*b* is fixed to the cross-linking rib 55 by welding, the inks are prevented from being mixed between the adjacent ink storage chambers 35*a* to 35*d*. Further, since the ridge portion 24*a* is not welded to the substrate 21 etc., the ridge portion 24*a* is capable of exhibiting flexibility.

Consequently, in such a damper device 25, when the pressure is fluctuated inside the ink storage chambers 35*a* to 35*d* and the negative pressure is generated, the ridge portion 24*a* and a side-wall surface 24*c* between the ridge portion 24*a* and the trough portion 24*b* (see FIG. 3) of the film 24 are deformed and bent (flexed) inward. Accordingly, the ink storage chambers 35*a* to 35*d* are deformed three dimensionally, and the volumes thereof are changed. Further, such deformation of the film 24 has a favorable response with respect to the pressure fluctuation since the film 24 is made of a flexible member, and it is possible to exhibit high damper performance. Moreover, with the deformation of the film 24, the apex portion 42 of the elastic wall 40 is also bent inward with respect to the base portion 41, and when the negative pressure is relieved, it is possible to restore the film 24 promptly to the original state by the elasticity of the elastic wall 40.

<Structure of Air Discharge Mechanism>

Figure 7:
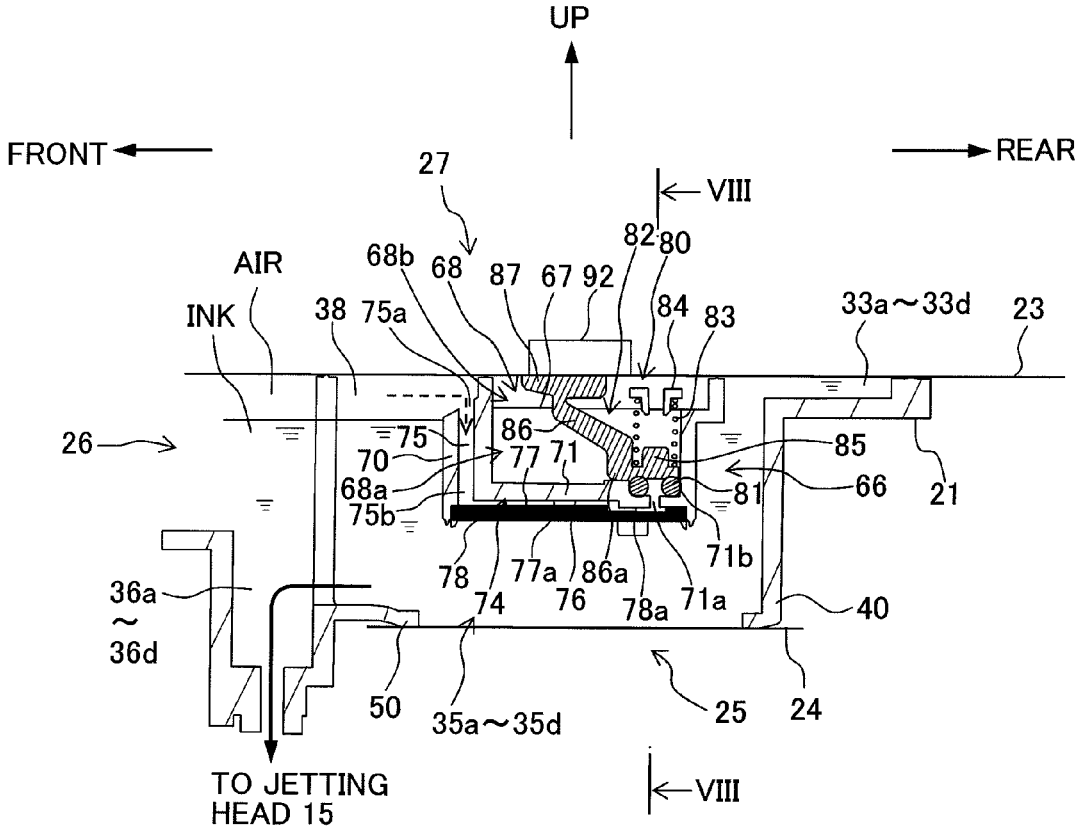
FIG. 7 is a diagram showing the structure of an air discharge mechanism, and is a cross-sectional view taken along a line VII-VII in FIG. 2.

As shown in FIG. 7, the air discharge mechanism 27 is provided such that at least a part thereof is immersed inside each of the ink storage chambers 35*a* to 35*d* included in the damper device 25; and in this embodiment, the air discharge mechanism 27 is relatively positioned at an upper side of the damper device 25. Further, the air discharge mechanism 27 and the damper device 25 which are arranged at the upper side and the lower side in this manner are provided, as seen in a side view, at positions which are lower than a position of the upper end (upper-end position) of each of the ink chambers 36*a* to 36*d* of the sub tank 26, and which are higher than a position of the lower end (lower-end position) of each of the ink chambers 36*a* to 36*d* of the sub tank 26. Consequently, the damper device 25, the sub tank 26, and the air discharge mechanism 27 are laid out such that the size in a plan view and the size in the side view of the damper unit 20 in which the damper device 25, the sub tank 26, and the air discharge mechanism 27 are assembled (combined) are compact, thereby contributing to the realization of small-sized damper unit 20.

Figure 8:
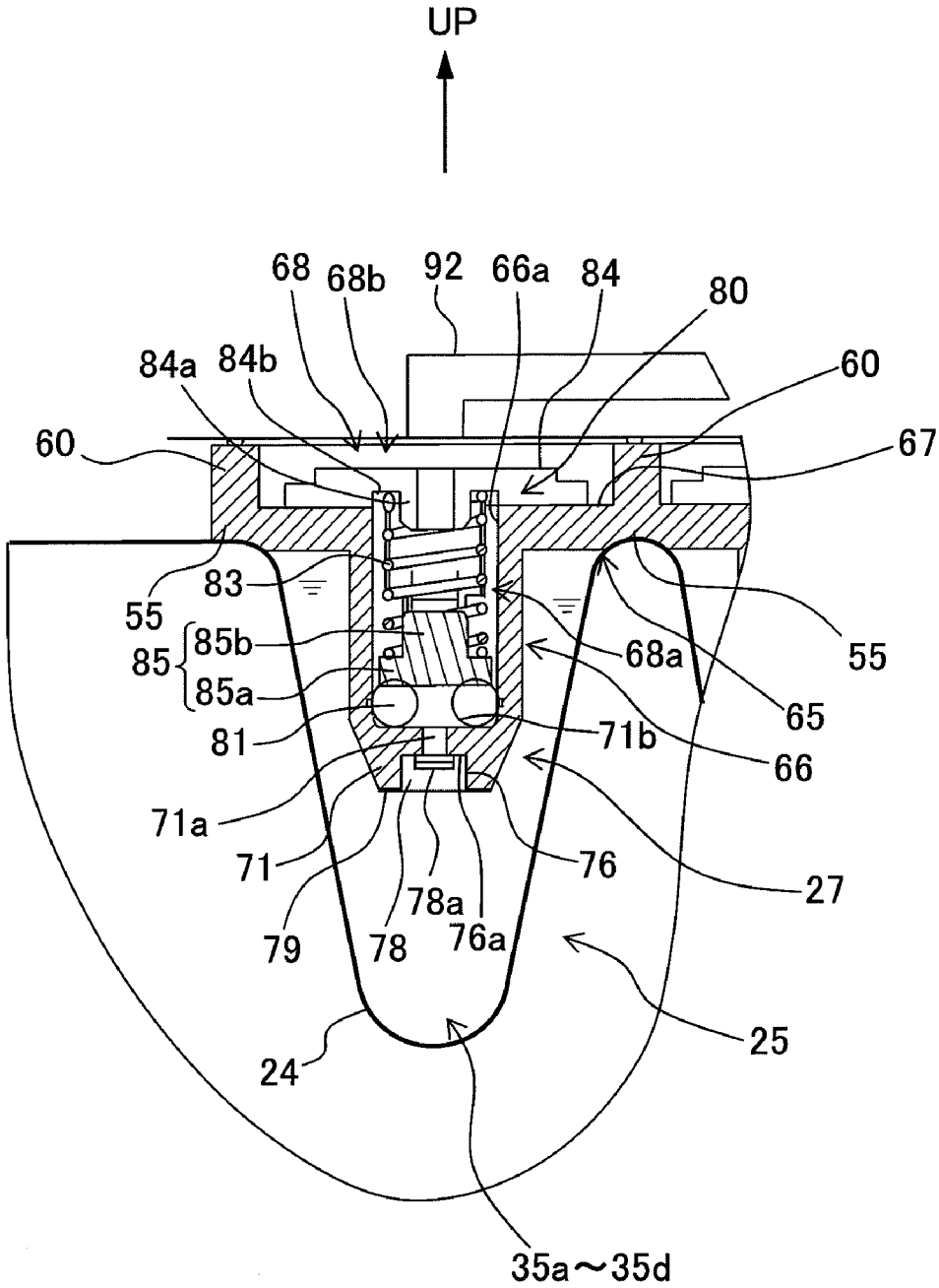
FIG. 8 is a diagram showing the structure of the air discharge mechanism, and is a cross-sectional view taken along a line VIII-VIII in FIG. 7.

Next, the air discharge mechanism 27 will be described below in detail. As shown in FIG. 8, a partition plate 65 which closes the upper portions of the ink storage chambers 35*a* to 35*d* is provided between two adjacent cross-linking ribs 55 among the plurality of cross-linking ribs 55 of the substrate 21. A bulged portion 66 which is bulged toward each of the ink storage chambers 35*a* to 35*d* located below the partition plate 65 is formed in the partition plate 65 at a central portion in the left-right direction between the two adjacent cross-linking ribs 55. Moreover, the connecting edge portion 60 as described above is formed to protrude from an upper portion of the cross-linking rib 55, and the film 23 which is a flexible member is attached (welded) to the upper surface of the connecting edge portion 60. Accordingly, a valve chamber 68 surrounded by the film 23 and the partition plate 65 is formed. The valve chamber 68 has a first chamber 68*a* which has a narrow width and which is formed inside the bulged portion 66, and a second chamber 68*b* which has a wide width, which is positioned above the first chamber 68*a* and of which upper portion is closed by the film 23. The first chamber 68*a* and the second chamber 68*b* communicate via an opening 66*a* of the bulged portion 66.

As shown in FIG. 7, the air discharge mechanism 27 includes a choke channel 74 which is provided along a front wall portion 70 and a bottom wall portion 71 of the bulged portion 66 (also see FIG. 8), and which communicates the valve chamber 68 and the air storage portion 38 which have already been described above. To explain specifically, as shown in FIG. 7, the front wall portion 70 of the bulged portion 66 has a double-wall structure in which a first channel 75 extended in the up and down (vertical) direction is formed. An upper-side opening 75*a* of the first channel 75 is open to communicate with the air storage portion 38 at the upper portion of each of the ink storage chambers 35*a* to 35*d*, and an opening surface of the upper-side opening 75*a* is inclined to be directed in the front direction and in the up direction toward the air storage portion 38. In this manner, the structure (arrangement) is provided such that air inside the air storage chamber 38 is easily introduced into the first channel 75.

Further, a fitting groove 76 which is dented in the up direction (upward) and extended in the front and rear direction is formed in the bottom wall portion 71 of the bulged portion 66 at a central portion in the left-right direction of bottom wall portion 71. Furthermore, in a bottom surface 76*a* of the fitting groove 76 (see FIG. 8), namely in the bottom surface 76*a* facing downward defined by the fitting groove 76 which is open in the down direction as shown in FIG. 8, a channel groove 77*a* is formed to extend in the front direction from the central portion of the bottom surface 76 in the longitudinal direction; and a lower-side opening 75*b* of the first channel 75 communicates with a front-end portion of the channel groove 77*a*. Moreover, a fitting member 78 which is long in the front and rear direction is fitted in the fitting groove 76 from below, and another channel groove 78*a* which is extended in the front and rear direction is formed on the upper surface of the fitting member 78, at a rear portion of the upper surface (rear-portion upper surface of the fitting member 78). The fitting member 78 is fitted into the fitting groove 76. With this, the channel grooves 77*a* and 78*a* are communicated, and thus a second channel 77 extending from the front-end portion up to the rear-end portion of the bottom wall portion 71 of the bulged portion 66 is formed.

The choke channel 74 having an L-shape in a side view as shown in FIG. 7 is formed by the second channel 77 and the first channel 75 formed in such manner. The choke channel 74 communicates with the first chamber 68*a* inside the bulged portion 66 via a communicating hole 71*a* which is formed in a rear portion of the bottom wall portion 71. FIG. 8 shows a state that the fitting member 78 is fitted into the fitting groove 76, and further that a film 79 is welded from a lower side thereof, and the air-tightness in the second channel 77 of the choke channel 74 is secured. However, the second channel 77 having such structure is highly air tight, and it is not necessarily indispensable that the film 79 is required.

Figure 9:
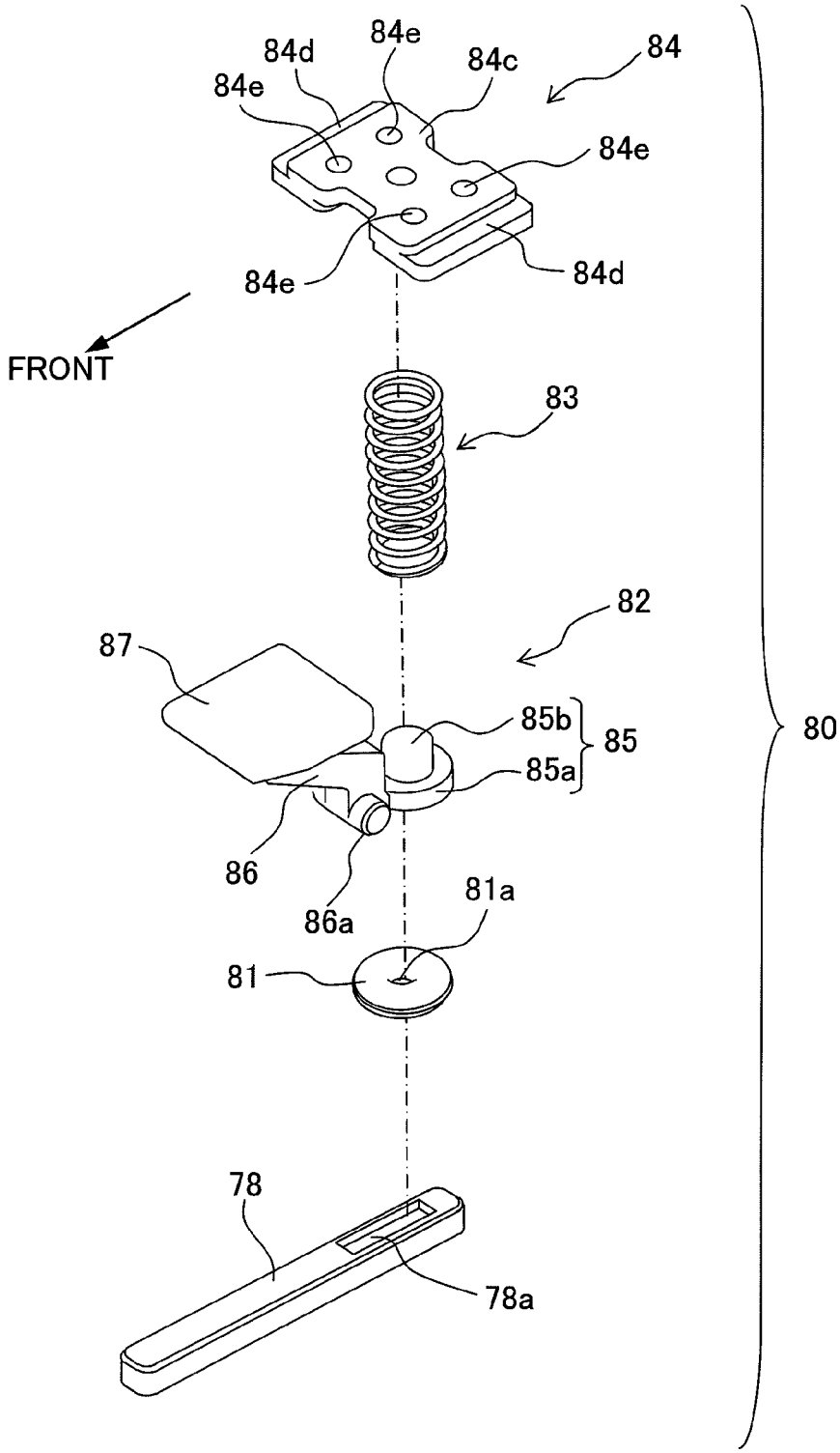
FIG. 9 is an exploded perspective view of main components of the air discharge mechanism.

On the other hand, a valve unit 80 which opens and closes the communicating hole 71*a* communicating with the choke channel 74 is accommodated in the valve chamber 68. As shown in FIG. 9, the valve unit 80 includes a seal member 81 made of a circular ring-shaped rubber member, a valve element 82 which opens and closes the communicating hole 71*a*, a coil spring 83 which applies a bias to the valve element 82 in a closing direction in which the communicating hole 71*a* is closed, and a spring supporting plate 84 which supports the coil spring 83.

As shown in FIG. 7, a recess 71*b* dented in the down direction (downward) is formed on the upper surface, of the bottom wall portion 71 of the bulged portion 66, at a rear side portion of the upper surface (rear-portion upper surface of the bottom wall portion 71). The communicating hole 71*a* is open at the center of the bottom portion of the recess 71*b*, and the seal member 81 having a circular-ring shape is accommodated in the recess 71*b* such that the center of a center hole 81*a* (see FIG. 9) coincides substantially with the center of the communicating hole 71*a* in a plan view.

As shown in FIG. 9, the valve element 82 has a valve portion 85 which is capable of closing the communicating hole 71*a* by being brought in or making contact with an upper portion of the seal member 81 so as to cover the center hole 81*a*, and an arm portion 86 which is extended from the valve portion 85. The diameter of an upper portion of the valve portion 85 is smaller than the diameter of a lower portion of the valve portion 85, and the valve portion 85 has, as a whole, a circular cylindrical shape with a stepped portion. The bottom surface of a lower portion 85*a* of the valve portion 85 is formed to be flat so as to make a close contact with the upper portion of the seal member 81. The arm portion 86 is extended from this lower portion 85*a*, and a pivot portion 86*a* which protrudes downward and which has a circular arc shaped contour in a side view is formed at a base portion of the arm portion 86 (in the vicinity of a connecting portion at which the arm portion 86 is connected to the lower portion 85*a* of the valve portion 85). The pivot portion 86*a* is brought in contact with the upper surface of the bottom wall portion 71 of the bulged portion 66 (see FIG. 7), and the valve element 82 is pivotable (pivotably movable) with the pivot portion 86*a* as the support point (fulcrum).

Further, the arm portion 86 is extended in the front direction and in the up direction inside the first chamber 68*a* from the valve portion 85, and is bent at an intermediate portion of the arm portion 86 and then arrives at the second chamber 68*b*. A contact portion 87 which is brought in contact, from a lower side, with the film 23 covering the upper portion of the valve chamber 68 is provided at a front end of the arm portion 86. As shown in FIG. 9, the shape of the contact portion 87 is substantially rectangular in a plan view, and the width of the contact portion 87 is greater than the width of the first chamber 68*a*. The upper surface of the contact portion 87 is flat, and an area of contact (contact area) with the film 23 is substantially (greatly) secured. In the partition plate 65, a portion which connects the cross-linking rib 55 and the bulged portion 66 forms a regulating portion 67 having a shape of a horizontal plate (see FIGS. 6 and 7). When the valve element 82 is pivoted (pivotably moved) with the pivot portion 82 as the support point, the contact portion 87 is brought in contact with the regulating portion 67, which in turn regulates the pivoting range, of the contact portion 87, in an opening direction in which the communicating hole 71*a* is opened.

On the other hand, as shown in FIG. 8, the coil spring 83 provided to an upper portion 85*b* of the valve portion 85 such that the direction of the central axis of the coil spring 83 coincides with the vertical direction is fitted to the upper portion 85*b* from the upper side; and the upper end of the coil spring 83 is supported by the spring supporting plate 84. The shape of the spring supporting plate 84 is a rectangular parallelepiped shape in a plan view, and a protruding portion 84*a* having a circular cylindrical shape is formed on the lower surface of the spring supporting plate 84 at a central portion on the lower surface to protrude in the down direction (downward). Further, a surrounding groove 84*b* which is dented (concaved) in the up direction (upward) to surround the protruding portion 84*a* is formed in the spring supporting plate 84. As shown in FIG. 9, left and right end portions on the upper surface of the spring supporting plate 84 are lower than the central portion by one stage or step. In other words, an upper-stage surface 84*c* is formed at the central portion of the upper surface of the spring supporting plate 84, and lower-stage surfaces 84*d* are formed at the left and right side thereof. Four caulking holes 84*e* penetrating in the up and down direction through the spring supporting plate 84 are formed at front and rear, and left and right positions of the upper-stage surface 84*c*.

As shown in FIG. 8, such a spring supporting plate 84 is connected to the upper surface of the partition plate 65 with the protruding portion 84*a* being fitted into the coil spring 83 from the upper side. At this time, four caulkings 65*a*, which are formed to protrude on the upper surface of the regulating portion 67 of the partition plate 65 (see FIG. 6), are inserted into the four caulking holes 84*e* of the spring supporting plate 84. Furthermore, a caulking lid which is not shown in the drawings is placed over the caulking hole 84*e* to cover the caulking hole 84*a*. In such a manner, the spring supporting plate 84 is fixed to the upper surface of the partition plate 65. At this time, since the coil spring 83 is accommodated in a compressed state between the spring supporting plate 84 and the valve portion 85, the valve portion 85 is biased in the down direction (downward) to thereby close the communicating hole 71*a*.

<Operation of Air Discharge Mechanism>

Figure 10A:
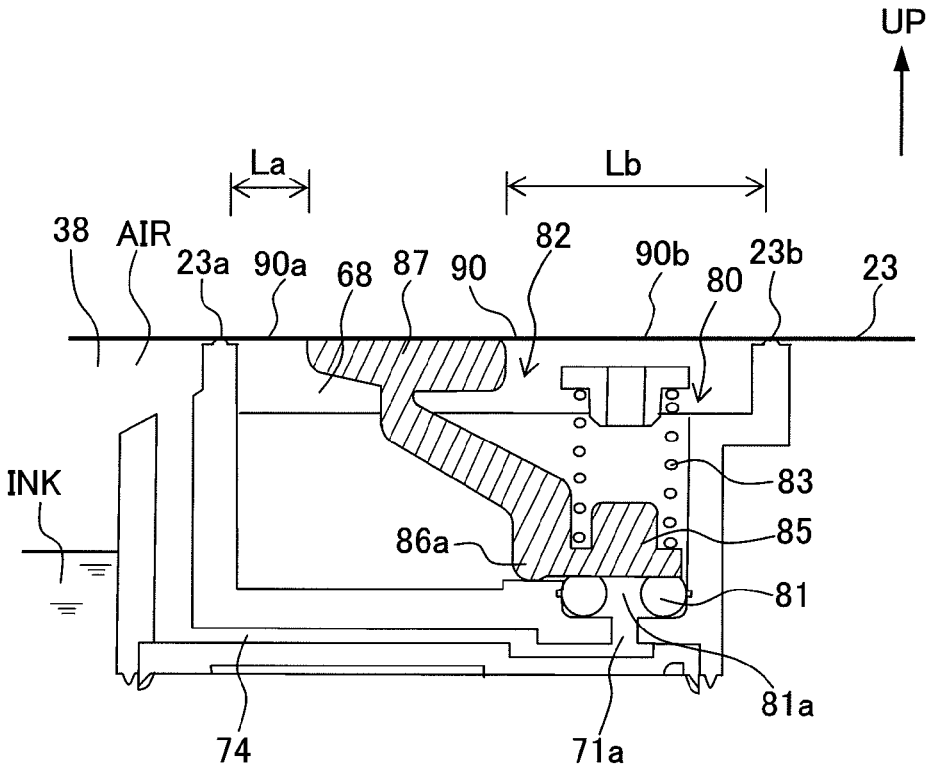

As shown in FIG. 10A, when the valve chamber 68 is at an atmospheric pressure, the valve portion 85 of the valve element 82 is biased in the down direction by the coil spring 83, and the lower portion 85*a* of the valve portion 85 is brought in contact with the upper portion of the seal member 81. As a result, the center hole 81*a* of the seal member 81 and the communicating hole 71*a* are closed, and the valve chamber 68 and the air storage portion 38 are cut (isolated) from each other.

Figure 10B:
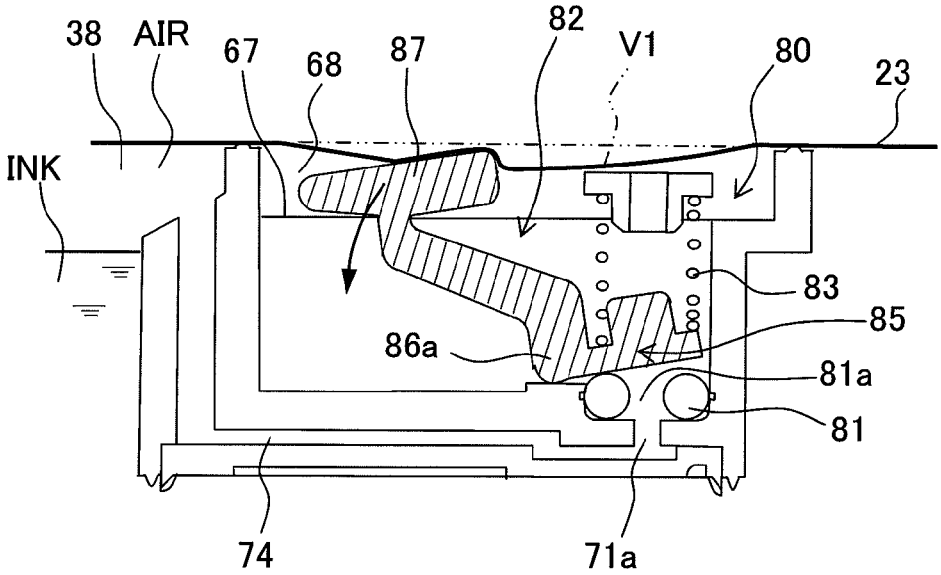

On the other hand, when the pump P (see FIG. 1) sucks the air via the air discharge tube 10, the negative pressure which is generated thereby is transmitted to each of the valve chambers 68 through the discharge-air introducing channel 31*e* and the discharge-air connecting channels 34*a* to 34*d* (also see FIG. 4). At this time, as shown in FIG. 10B, the film 23 which is a flexible member is deformed downward, thereby pushing or pressing the contact portion 87 downward, and thus the valve 82 is pivoted with the pivot portion 86*a* as the support point. This displaces the valve portion 85 upward, and the lower portion 85*a* of the valve portion 85 is separated and away from the seal member 81, thus causing a gap to be formed or provided. At this time, the valve chamber 68 communicates with the air storage portion 38 via the center hole 81*a* of the seal member 81, the communicating hole 71*a*, and the choke channel 74. Note that in this embodiment, the film 23 is used as a flexible member which makes a contact with the contact portion 87 of the valve element 85. However, the present invention is not limited to such construction or arrangement. It is allowable to use other flexible member provided that the other flexible member is capable of sealing the valve chamber 68 to be liquid tight, and is also capable of being deformed by the negative pressure to thereby press or push the contact portion 87 as described above. For example, it is also possible to use a thin rubber material, instead of using the film 23.

In this state, when the negative pressure is continuously generated by the pump P, the air in the air storage portion 38 is sucked into the valve chamber 68 through the choke channel 74. The sucked air passes through the discharge-air connecting channels 34*a* to 34*d* and the discharge-air introducing channel 31*e*, and is further discharged to the outside through the air discharge tube 10. As a result, it is possible to discharge the air inside the air storage portion 38, and to increase the capacity for storing the ink in the ink storage chambers 35*a* to 35*d* and the tank chambers 36*a* to 36*d*; and it is also possible to store the air in the air continuously in the air storage portion 38.

Note that as shown in FIG. 10A, in the air discharge mechanism 27 according to the embodiment, the contact portion 87 of the valve element 82 is arranged at a position nearer to the front side with respect to a deformation area of the film 23 covering the upper portion of the valve chamber 68, and the valve element 82 is easily pivotable by the deformation of the film 23.

To explain more in detail, the film 23 covering the valve chamber 68 has a front-side restricting position 23*a* at which the film 23 is connected to an upper-end portion of the front wall portion 70 of the bulged portion 66, and a rear-side restricting position 23*b* at which the film 23 is connected to an upper-end portion of the rear wall portion 72; and a deformation area 90 is formed between the front-side restricting position 23*a* and the rear-side restricting position 23*b*. Further, the deformation area 90 includes a front-side deformation area 90*a* which is formed between the front end of the contact portion 87 and the front-side restricting position 23*a*, and a rear-side deformation area 90*b* which is formed between the rear end of the contact portion 87 and the rear-side restricted position 23*b*. Furthermore, in this embodiment, the position of the contact portion 87 is set such that a dimension Lb in the front and rear direction of the rear-side deformation area 90*b* is greater than a dimension La in the front and rear direction of the front-side deformation area 90*a*.

By providing such a construction, as shown in FIG. 10B, when the film 23 is deformed downward due to the negative pressure, the rear-side deformation area 90*b* is turned around (moved around) toward the rear portion of the contact portion 87, thereby making it possible to press the contact portion 87 downward and frontward, and to easily pivot the valve element 82 in the opening direction.

Further, as shown in FIG. 10B, the air discharge mechanism 27 is provided with the regulating portion 67 which regulates the range in which the contact portion 87 is pivoted in the opening direction, and the maximum amount of opening of the communicating holes 71*a* by the valve elements 82 is set to be the same. Therefore, variation in an amount of air discharged from each air storage portion 38 is suppressed. In a case that the viscosity differs among the inks depending on the color of the inks, and in a case that degree or extent of an accumulation of air differs among the inks depending on the color of the inks, it is allowable to perform setting such that the pivoting range of the valve element 82 differs for each color ink, by changing the position in the vertical direction of the restricting portion 67. Moreover, for suppressing the variation in the amount of air discharged from each air storage portion 38, the air discharge mechanism 27 according to this embodiment is provided with a stabilizer 92 which tunes (synchronizes) the deformation of each deformation area 90 in the film 23 corresponding to one of the valve chambers 68.

Figure 12:
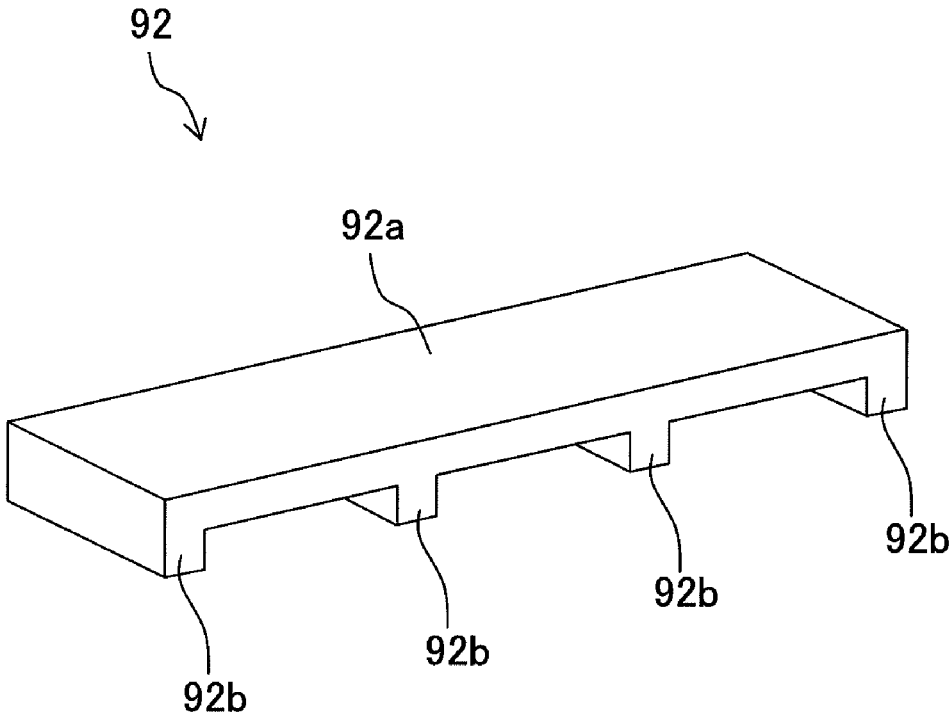
FIG. 12 is a perspective view of the structure of a stabilizer.

FIG. 12 is a perspective view showing the structure of the stabilizer 92. As shown in FIG. 12, the stabilizer 92 includes a transmission plate 92*a* which is long in the left-right direction, and four connecting portions 92*b* extended downward from the transmission plate 92*a*; and the transmission plate 92*a* and the four connecting portions 92*b* are integrally formed. The lower end of each of the connecting portions 92*b* is adhered to the deformation area 90 of the film 23 located above or over the upper portion of one of the valve chambers 68. More precisely, the lower end of each of the connecting portions 92*b* is adhered to the upper surface of the film 23 in the deformation area 90 at a position facing the contact portion 87 of the valve element 82 (see FIG. 7).

In such a stabilizer 92, when the deformation area 90 in the film 23 corresponding to one of the valve chambers 68 is deformed, a connecting portion 92*b* among the connecting portions 92*b* which corresponds to the deformation area 90 is displaced following the deformation, and this displacement of the connecting portion 92*b* is transmitted to other connecting portion or portions 92*b* via the transmission plate 92*a*, thereby deforming the deformation area 90 corresponding to other valve chamber or chambers 68. Therefore, it is possible to realize uniform the deformation among the deformation areas 90, and thus it is possible to substantially match a timing of the opening and closing operation among the valve elements 82 and to realize uniform opening amount therefor.

Note that in a case in which the amount of air sucked by the pump P is large, there is a possibility that the ink might enter into the valve chamber 68, and furthermore, there is a possibility that the ink might outflow to the discharge-air connecting channels 34*a* to 34*d* and the discharge air introducing channel 31*e*. In this case, the inks of different colors entered into the discharge-air connecting channels 34*a* and 34*b* are mixed at the discharge-air connecting channel 34 located at the downstream of a combining (merging) location at which the inks are mixed, and similarly, the inks entered into the discharge-air connecting channels 34*c* and 34*d* are mixed at the discharge-air connecting channel 34 located at the downstream of the combining location. Consequently, when the mixed inks flow in a reverse direction due to relieving of the negative pressure, and when such reversed inks return to the valve chamber 68, there is a possibility that the inks of different colors enter into the ink storage chambers 35*a* to 35*d* and the tank chambers 36*a* to 36*d*, from the valve chamber 68 through the choke channel 74, which in turn causes problem or inconvenience.

Figure 11:
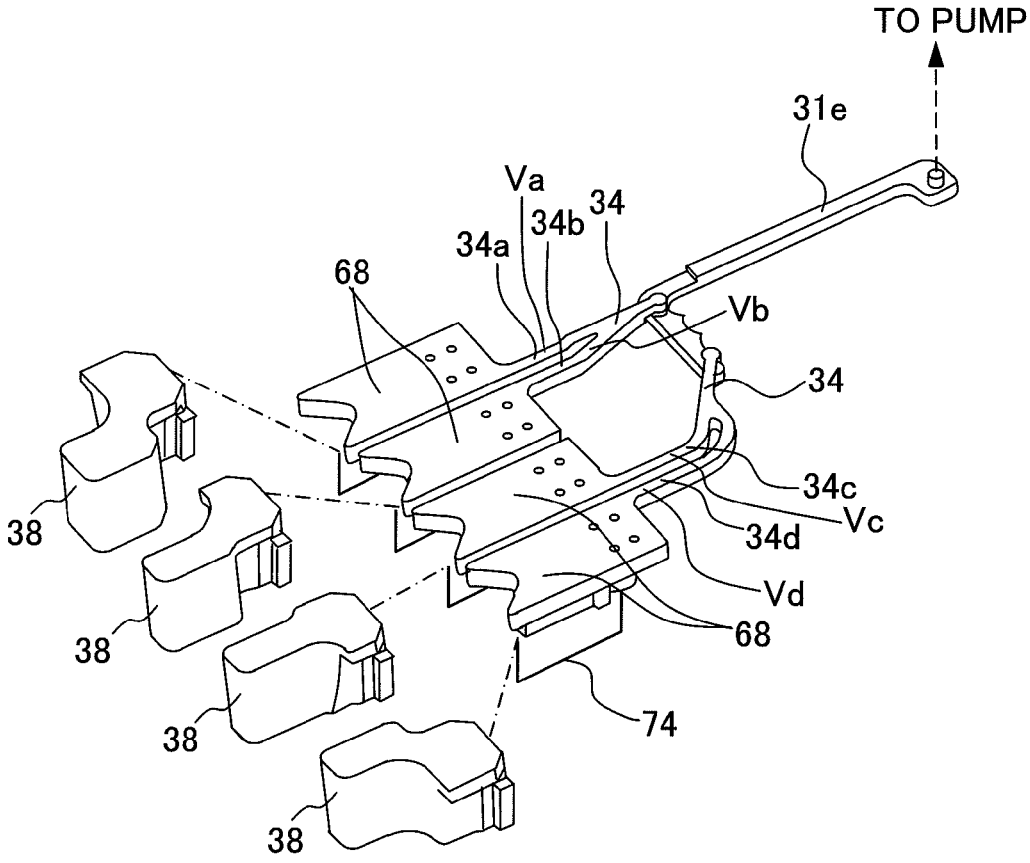
FIG. 11 is a perspective view of an air discharge passage of the substrate from an air storage portion up to a discharge-air tube connecting hole.

On the other hand, the air discharge mechanism 27 according to the embodiment is provided with a structure for preventing the inks mixed in such manner from flowing in the reverse direction from the discharge-air connecting channel 34 to the valve chamber 68. In other words, as shown in FIG. 10B, when the communicating hole 71*a* is not opened to the maximum opening extent, the construction is provided such that the capacity of the valve chamber 68 is decreased by only a predetermined volume V1 than in a normal case (state shown in FIG. 10A). Consequently, when the film 23 regains the state in FIG. 10A from the state in FIG. 10B due to the relief of negative pressure in the valve chamber 68, there is a possibility that the inks mixed at the downstream side of the combining location flows in the reverse direction, at maximum, only an amount which is equivalent to the volume V1. However, as shown in FIG. 11, the discharge-air connecting channels 34*a* to 34*d* have volumes Va to Vd respectively which are greater than the volume V1. Consequently, even when the film 23 regains the original shape, the inks mixed at the downstream side of the combining location are unable to return beyond each of the discharge-air connecting channel 34*a* to 34*d*, and thus cannot arrive at the valve chamber 68.

<Method of Manufacturing Air Discharge Mechanism>

Figure 13:
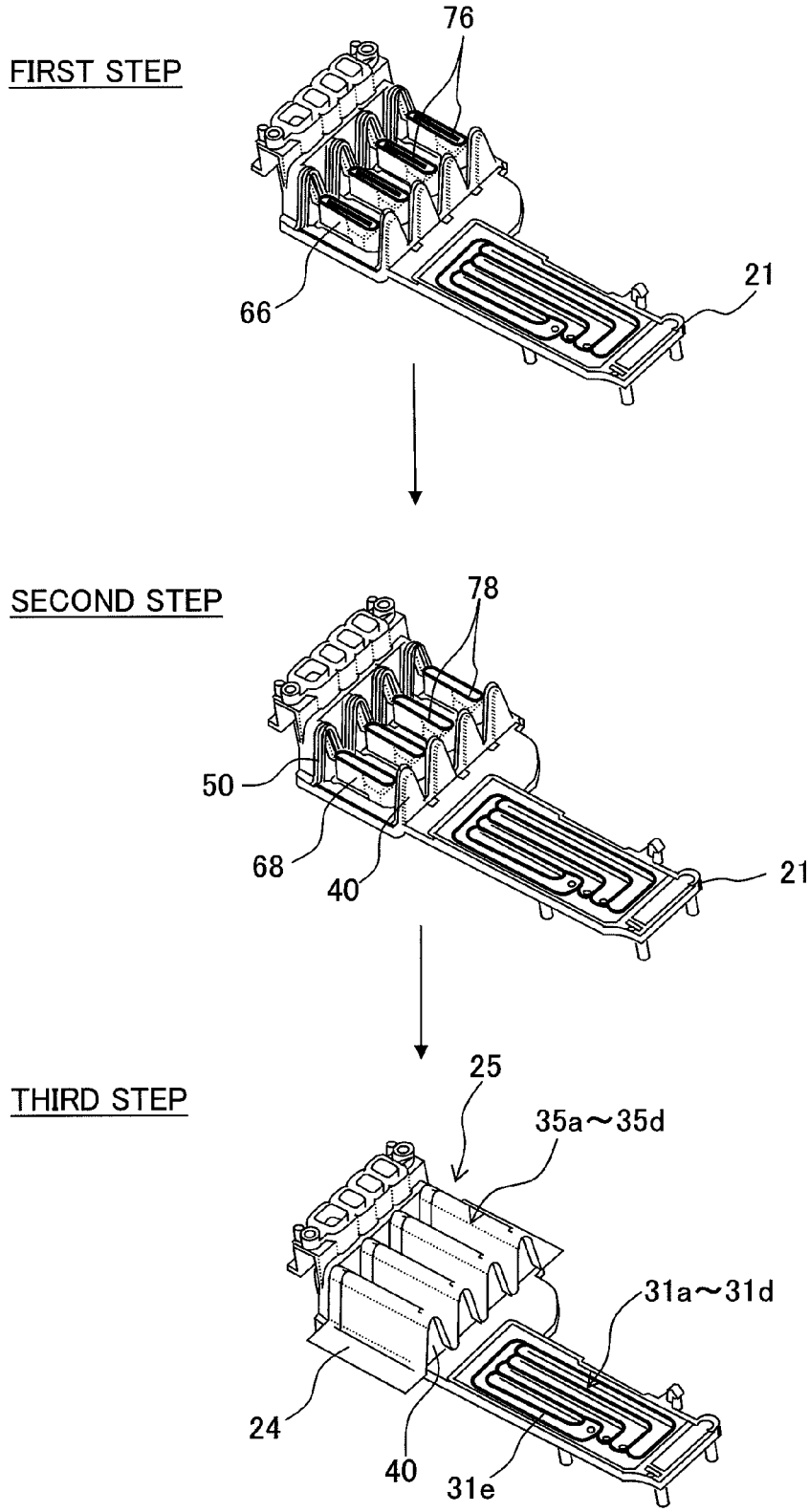
FIG. 13 is a diagram for explaining a method of manufacturing the air discharge mechanism while dividing the method into a first step to a sixth step, and shows the first to third steps among the steps.

As shown in FIG. 13, the substrate 21 is arranged up side down (first step); and the fitting member 78 is fitted, with respect to the substrate 21 in the up side down state, into the fitting groove 76 formed in the bottom wall portion 71 of the bulged portion 66 and is welded thereto (second step). Accordingly, the choke channel 74 is formed. Next, the film 24 is welded to the supporting edge portions 50 and the elastic walls 40 protruding from the substrate 21 (third step), and thus the ink storage chambers 35*a* to 35*d* of the damper device 25 are formed.

Figure 14:
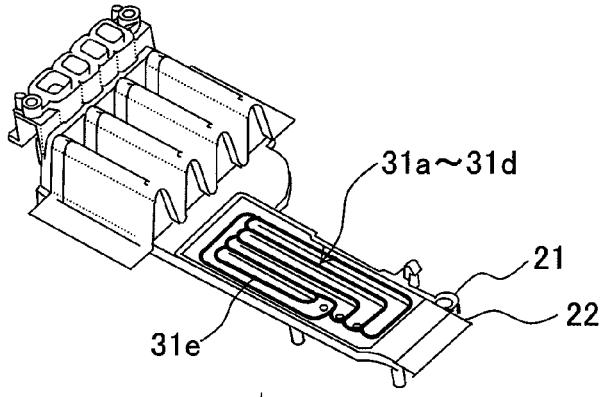
FIG. 14 is a diagram for explaining the method of manufacturing of the air discharge mechanism while dividing the method into the first step to the sixth step, and shows steps the fourth to sixth steps.
Figure 14:
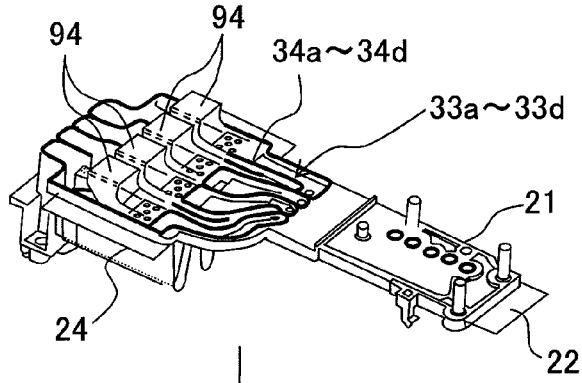
Figure 14:
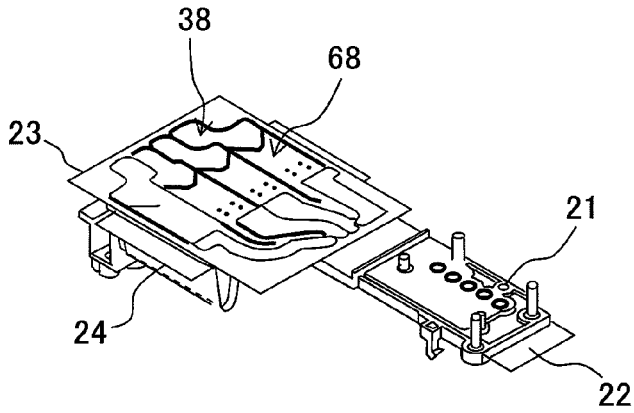

Next, as shown in FIG. 14, the film 22 is welded to the lower surface of the channel forming portion 21*a* of the substrate 21, and thus the ink introducing channels 31*a* to 31*d* and the discharge-air introducing channel 31*e* are formed (fourth step). Here, the substrate 21 is turned up side down and brought to a normal (regular) posture; and after the valve unit 80 including the seal member 81, the valve element 82, the coil spring 83, etc. is accommodated inside each of the valve chambers 68, the spring supporting plate 84 is attached to the upper surface of the partition wall 65 by using a predetermined jig 94 (fifth step). Finally, the jig 94 is removed and the film 23 is welded. With this, the ink connecting channels 33*a* to 33*d*, and the discharge-air connecting channels 34*a* to 34*d* are formed, and also the air storage portion 38 and the valve chamber 68 are sealed (sixth step).

Figure 15:
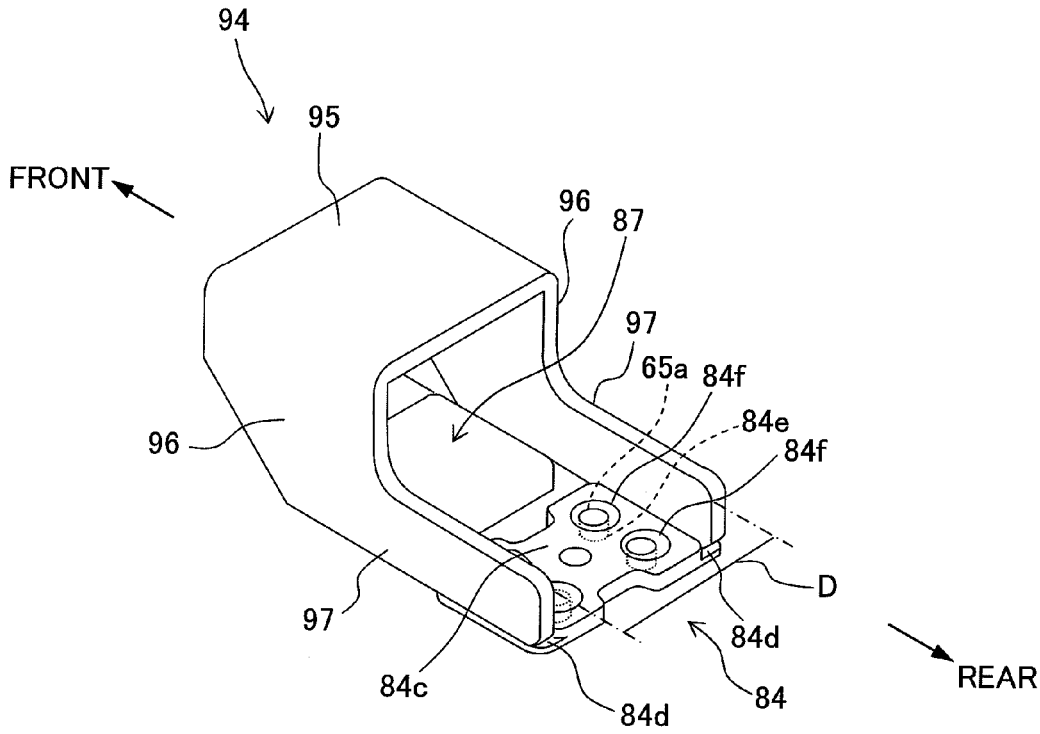
FIG. 15 is a perspective view for explaining a method of attaching a spring supporting plate with a jig, which is carried out at the fifth step.

As shown in FIG. 15, the jig 94 is substantially arch-shaped in a rear view; and includes a pressing plate 95 which is rectangular shaped in a plan view, extended portions 96 extended downward from left and right end portions of the pressing plate 95, and supporting plates 97 each extended rearward from a lower portion of one of the extended portions 96. The supporting plates 97 on the left and right sides are separated by a predetermined distance dimension D, and this distance dimension D is substantially same as a distance dimension of the lower-stage surfaces 84*d* at left and right of the spring supporting plate 84 (in other words, the width dimension of the upper-stage surface 84*c*). The pressing plate 95 is positioned at the front side with respect to the supporting plates 97, and a space located right above the supporting plates 97 is open.

In a case that the spring supporting plate 84 is fixed to the substrate 21 by using such jig 94, at first, the spring supporting plate 84 is arranged on the partition plate 65 of the substrate 21 such that the caulkings 65*a* are inserted into the caulking holes 84*e*. Next, the lower ends of the supporting plates 97 on the left and right of the jig 94 are brought in contact, from an upper side, with the lower-stage surfaces 84*d* on left and right of the spring supporting plate 84. In this state, the pressing plate 95 is pressed or pushed from the upper side so as to support the spring supporting plate 84 such that there is no shift or deviation in position. Then, lids 84*f* are placed to cover the caulking holes 84*e*; and a heater (not shown in the drawings) is brought, from the upper side, in a pressed contact with the upper-stage surface 84*c* of the spring supporting plate 84 to thereby perform thermal caulking. Accordingly, the spring supporting plate 84 is firmly connected to the partition plate 65 of the substrate 21, and thus the spring supporting plate 84 does not fall off or apart even due to the bias of (force applied by) the coil spring 83.

According to the printing apparatus 1 including the liquid supply unit 4 as described above, it is not necessary to separately provide any valve-element opening mechanism, etc., in addition to the pump P; and it is possible to drive the air discharge mechanism 27, with the negative pressure for discharging the air by the pump, so as to communicate the air storage portion 38 and the valve chamber 68. In this manner, with the ability to discharge air, it is possible to make the capacity of the air storage portion 38 be small, thereby realizing the small-sized liquid supply unit 4, as well as realizing the small-sized printing apparatus 1 because there is no need to use any valve-element opening mechanism separately. In addition, since the liquid supply unit 4 and the pump P are connected by the air discharge tube 10 all the time, it is possible to carry out the air-discharge operation even without making the liquid supply unit 4 be stopped at a specific position, and it is possible to secure the air-tightness of the discharge air path comparatively easily.

Figure 16A:
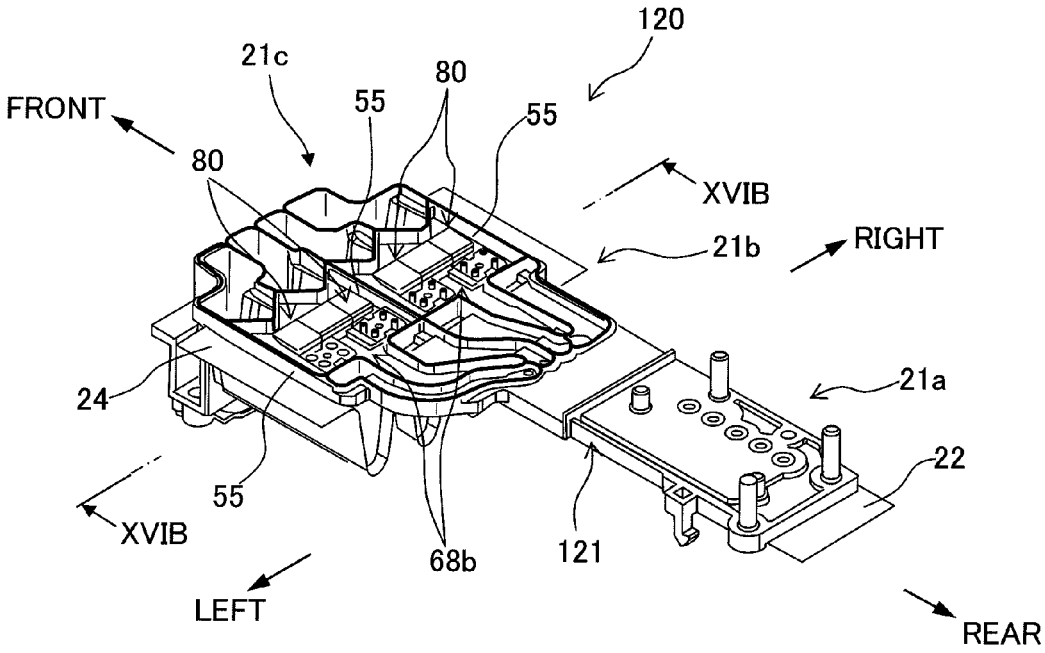
Figure 16B:
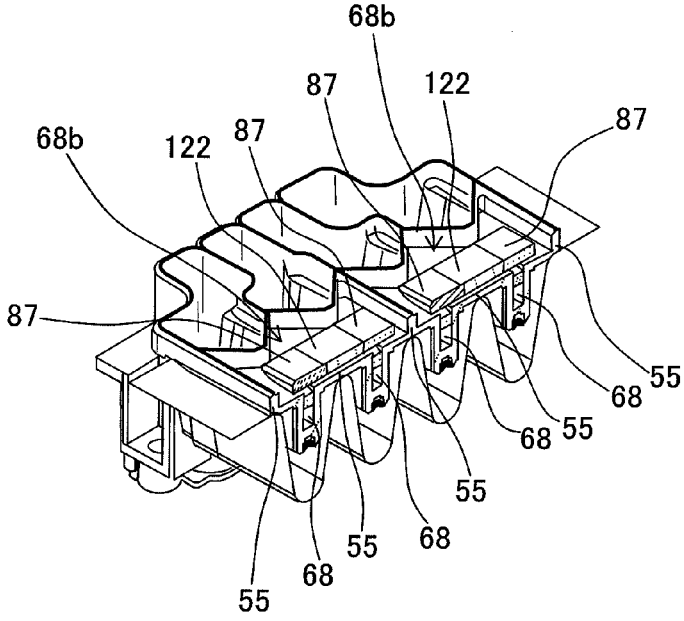

Note that although the above-described embodiment is explained in relation to the construction in which the valve elements 85 accommodated in the valve chambers 68 respectively are operated independently. However, it is allowable to adopt a construction in which a plurality of valve elements 85 is formed integrally and to make the integrally-formed valve elements 85 be operable simultaneously by the deformation of the film 23. FIGS. 16A and 16B show another construction of the damper unit as an example of such air discharge air mechanism.

As shown in FIGS. 16A and 16B, a damper unit 120 includes a substrate (channel forming substrate) 121 having a similar structure mostly as the structure of the substrate 21 in the damper unit 20 already explained above. However, in the damper forming portion 21*b* of the substrate 121, the connecting edge portion 60 for being welded with to the film 23 is not provided on the upper surface of a cross-linking rib 55 dividing two adjacent ink storage chambers 35*a* and 35*b* at the right side, and is not provided on the upper surface of a cross-linking rib 55 dividing two adjacent ink storage chambers 35*c* and 35*d* at the left side. Consequently, two valve chambers 68 at the right side which are arranged above (at the upper side of) the ink storage chambers 35*a* and 35*b* have upper portions thereof communicating with each other to define a common second chamber 68*b* that is wide in the left-right direction, and similarly two valve chambers 68 at the left side which are arranged above the ink storage chambers 35*c* and 35*d* have upper portions thereof communicate with each other to define a common second chamber 68*b* that is wide in the left-right direction.

Among these four valve chambers 68, the valve chambers 68, 68 on the right side accommodate the valve units 80 respectively which are similar to the valve units as already described above, and the contact surfaces 87 of the valve elements 85 of the valve units 80 are connected with each other by a joint member 122 having a rectangular-plate form. The joint member 122 has a thickness similar to that of the contact portion 87, and the upper surface of the joint member 122 is formed to be a flat surface. The joint member 122 and the contact portions 87 on the left and right side thereof which sandwich the joint member 122 have the upper surfaces and the lower surfaces which are substantially flush with each other. Further, also with respect to the valve units 80 accommodated in the valve chambers 68 respectively on the left side, the contact portions 87 are connected by the joint member 122, and have a similar structure.

Moreover, in a state that such valve units 80 are accommodated in the valve chambers 68, the film 23 (not shown in the drawings) is welded from the upper side to the damper forming portion 21*b* and the tank forming portion 21*c* of the substrate 121. As a result, a state is provided in which the lower surface of the film 23 is brought into contact with the upper surface of the joint member 122 and the upper surfaces of the contact portions 87 connected by the upper surface of the joint member 122. According to such a construction, when the film 23 is deformed, the two contact portions 87 connected by the joint member 122 are moved (operated) at a same timing, and thus it is possible to synchronously operate the two adjacent valve units 80. Consequently, it is possible to suppress the variation in operation timing among the valve units 80.

In the damper unit 120 shown in FIG. 16, same reference numerals are assigned to components or parts having a similar structure as those in the damper unit 20 already explained as above, and the description of such components is omitted. Further, although the explanation has been given regarding the two adjacent valve units 80 while showing the structure in which the two contact portions 87 are connected integrally. However, it is also possible, also regarding all the three or four adjacent valve units 80, to provide a structure in which the contact portions 87 are connected integrally. Furthermore, the joint member 122 and the valve elements 85 having the contact portions 87 may be formed separately and then may be integrated by welding, or may be formed as an integrated part from the beginning.

The present invention is applicable to a head unit with an air discharge mechanism which is capable of discharging air accumulated or existing in at an intermediate portion of the liquid supply channel of the liquid supply unit, and in which the small size can be realized for the apparatus.

What is claimed is:

1. A liquid jetting apparatus which jets a liquid, comprising:

a liquid jetting head;

a liquid supply channel which supplies the liquid to the liquid jetting head;

an air discharge mechanism which discharges air existing in the liquid to be supplied to the liquid jetting head, the air discharge mechanism including an air storage portion which is provided at an intermediate portion of the liquid channel, and which temporarily stores air in the liquid, at least one air discharge passage which extends from the air storage portion up to an outside of the air discharge mechanism, at least one valve which opens and closes the air discharge passage, and a flexible member which is deformed in accordance with a pressure inside the air discharge passage;

wherein when a negative pressure is generated in the air discharge passage, the flexible member is deformed to open the valve, and to discharge the air inside the air storage portion to the outside via the air discharge passage, wherein the flexible member comprises a film that forms a portion of the air discharge passage, wherein the valve comprises a valve element configured to selectively open and close the air discharge passage, and an arm extending from the valve element to contact the film, wherein, when the film is deformed, the arm and the valve member are configured to pivot to selectively open and close the air discharge passage, wherein the arm comprises a contact portion that contacts the deformed film, and the arm is configured to regulate a movement of the valve by the contact portion moving along a predetermined direction, such that the valve element moves between an open position, in which the air discharge passage is open, and a closed position, in which the air discharge passage is closed, and wherein, when the contacting portion moves in the predetermined direction due to a deformation of the film, the valve element moves from the closed position to the open position.

2. The liquid jetting apparatus according to claim 1, wherein the valve is formed as a plurality of valves; and the air discharge mechanism is provided with a regulating portion which regulates a range of pivoting angle of the arm of each of the valves.

3. The liquid jetting apparatus according to claim 1, further comprising a channel forming substrate which supports the valve and in which the air discharge channel is formed;

wherein the channel forming substrate is formed with a discharge-air tube connecting port which is provided at a downstream side of air-discharge with respect to the valve and which is connected to a pump located an outside region via a tube, and a liquid tube connecting port to which a tube supplying the liquid from the outside is connected; and the discharge-air tube connecting port and the liquid tube connecting port are arranged closely to each other.

4. The liquid jetting apparatus according to claim 1, wherein the at least one valve comprises a plurality of valves, and the plurality of valves are constructed to be driven integrally.

5. The liquid jetting apparatus according to claim 1, wherein the at least one valve comprises a plurality of valves;

the film has a plurality of deformation areas corresponding to the valves respectively; and the air discharge mechanism further includes a synchronizing member which is brought in contact with an outer surface of each of the deformation areas and which transmits a deformation of one deformation area among the deformation areas to other deformation area.

6. The liquid jetting apparatus according to claim 1, wherein the film is formed as stacked thin films, and a total thickness of the film is approximately 50 μm.

7. The liquid jetting apparatus according to claim 1, wherein the valve further comprises a coil spring configured to bias the valve element toward the air discharge passage to close the air discharge passage.

8. The liquid jetting apparatus according to claim 1, wherein the valve further comprises a pivoting portion about which the arm and the valve element pivot to selectively open and close the air discharge passage, wherein the arm and the pivoting portion are formed integrally, and wherein the valve element is separated from the contacting portion in a direction perpendicular to a direction in which the film is deformed due to the negative pressure generated in the air discharge passage.

9. The liquid jetting apparatus according to claim 1, wherein a shape of the contact portion of the arm at which the arm is brought into contact with the film has a flat shape and faces the film.

10. The liquid jetting apparatus according to claim 9, wherein in a state that the valve element is closed, the contact portion is arranged at a position at which a dimension from the contact portion of the arm up to an end portion of a deformation area of the film in a direction from the valve element toward the contact portion is greater than a dimension from the contact portion of the arm up to an end of the deformation area in the direction from the contact portion toward the valve element.

11. The liquid jetting apparatus according to claim 1, wherein the air discharge mechanism includes a plurality of pieces of the valve, and a plurality of valve chambers which accommodate the valves and each of which stores air at an upper portion thereof;

the air discharge passage is formed as air discharge passages each of which is extended from the upper portion of one of the valve chambers; and the air discharge passages are converged with each other at intermediate portions thereof.

12. The liquid jetting apparatus according to claim 11, wherein a volume of an air discharge passage, among the air discharge passages, from a connection location thereof with one of the valve chambers up to a converging location thereof at which the air discharge passage is converged with other air discharge passage is greater than an change amount of a volume of the valve chamber due to deformation of the film.

13. The liquid jetting apparatus according to claim 1, further comprising a damper mechanism which is provided at an intermediate portion of the liquid channel, and which reduces a pressure fluctuation in the liquid;

wherein the air discharge mechanism is arranged at a position above the damper mechanism.

14. The liquid jetting apparatus according to claim 13, further comprising a liquid tank which is provided on the liquid channel at a downstream side of the damper mechanism, and which temporarily stores the liquid which is to be supplied to the liquid jetting head;

wherein the air discharge mechanism and the damper mechanism are arranged in a space which is located below an upper-end position of the liquid tank and located above a lower-end position of the liquid tank.

15. The liquid jetting apparatus according to claim 14, wherein the air storage portion is formed at an upper portion of the liquid tank;

the air discharge mechanism further includes a choke channel which communicates the air storage portion and the valve; and the choke channel is provided in the damper mechanism such that at least a part thereof is immersed inside a liquid storage portion which temporarily stores the liquid.

16. The liquid jetting apparatus according to claim 15, wherein the air storage portion has an inclined surface in which an inlet, to the choke channel, is formed.

17. A liquid supply unit which is provided on a liquid jetting apparatus including a liquid jetting head and jetting a liquid, the liquid supply unit comprising:

a liquid supply channel which supplies the liquid to the liquid jetting head; and an air discharge mechanism which discharges air inside the liquid supply channel, the air discharge mechanism including an air storage portion which is provided at intermediate portion of the liquid supply channel and temporarily stores air in the liquid, a valve which opens and closes an air discharge passage extending from the air storage portion to an outside of the air discharge passage, and a flexible member which is deformed in accordance with a pressure inside the air discharge passage;

wherein when a negative pressure is generated in the air discharge passage, the flexible member is deformed to open the valve and to discharge the air inside the air storage portion to the outside via the air discharge passage;

wherein the flexible member comprises a film that forms a portion of the air discharge passage, wherein the valve comprises a valve element configured to selectively open and close the air discharge passage, and an arm extending from the valve element to contact the film, wherein, when the film is deformed, the arm and the valve member are configured to pivot to selectively open and close the air discharge passage, wherein the arm comprises a contact portion that contacts the deformed film, and the arm is configured to regulate a movement of the valve by the contact portion moving along a predetermined direction, such that the valve element moves between an open position, in which the air discharge passage is open, and a closed position, in which the air discharge passage is closed, and wherein, when the contacting portion moves in the predetermined direction due to a deformation of the film, the valve element moves from the closed position to the open position.

* * * * *